US008678921B2

(12) United States Patent
Nicely

(10) Patent No.: US 8,678,921 B2
(45) Date of Patent: Mar. 25, 2014

(54) GAMING SYSTEM, GAMING DEVICE, AND METHOD PROVIDING PLAYER-SELECTABLE CARD DEALING ATTRIBUTES

(75) Inventor: Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 136 days.

(21) Appl. No.: 13/249,542

(22) Filed: Sep. 30, 2011

(65) Prior Publication Data

US 2013/0084947 A1 Apr. 4, 2013

(51) Int. Cl.
*A63F 9/24* (2006.01)

(52) U.S. Cl.
USPC ..... 463/31; 463/22; 463/11

(58) Field of Classification Search
USPC ..... 463/22, 11, 30, 31
See application file for complete search history.

(56) References Cited

U.S. PATENT DOCUMENTS

| | | | |
|---|---|---|---|
| 6,068,552 | A | 5/2000 | Walker et al. |
| 6,110,041 | A | 8/2000 | Walker et al. |
| 6,165,069 | A | 12/2000 | Sines et al. |
| 6,254,483 | B1 | 7/2001 | Acres |
| 6,270,404 | B2 | 8/2001 | Sines |
| 6,293,866 | B1 | 9/2001 | Walker et al. |
| 6,350,199 | B1 | 2/2002 | Williams et al. |
| 6,375,567 | B1 | 4/2002 | Acres |
| 6,407,761 | B1 | 6/2002 | Ching |
| 6,520,856 | B1 | 2/2003 | Walker et al. |
| 6,651,985 | B2 | 11/2003 | Sines et al. |
| 6,722,974 | B2 | 4/2004 | Sines et al. |
| 6,769,986 | B2 | 8/2004 | Vancura |
| 6,843,723 | B2 | 1/2005 | Joshi |
| 6,939,226 | B1 | 9/2005 | Joshi |
| 6,991,543 | B2 | 1/2006 | Joshi |
| 7,048,629 | B2 | 5/2006 | Sines et al. |
| 7,255,642 | B2 | 8/2007 | Sines et al. |
| 7,427,233 | B2 | 9/2008 | Walker et al. |
| 7,753,789 | B2 | 7/2010 | Walker et al. |
| 7,771,269 | B2 | 8/2010 | Kuhn et al. |
| 7,878,892 | B2 | 2/2011 | Sines et al. |
| 8,016,659 | B2 | 9/2011 | Kuhn et al. |
| 8,323,102 | B2 * | 12/2012 | Lutnick et al. ..... 463/29 |
| 2002/0142825 | A1 | 10/2002 | Lark et al. |
| 2002/0142846 | A1 | 10/2002 | Paulsen |
| 2002/0152120 | A1 | 10/2002 | Howington |
| 2002/0187834 | A1 | 12/2002 | Rowe et al. |
| 2002/0193099 | A1 | 12/2002 | Paulsen |
| 2004/0005919 | A1 | 1/2004 | Walker et al. |

(Continued)

*Primary Examiner* — Tramar Harper
*Assistant Examiner* — Anh Vo V Nguyen
(74) *Attorney, Agent, or Firm* — Neal, Gerber & Eisenberg LLP

(57) ABSTRACT

A gaming system, device, and method providing player selectable card dealing attributes. The system enables a player to play a dealer-based game and includes a plurality of different card dealing attributes. In one embodiment, the system includes a plurality of predetermined dealers each associated with one or more of the card dealing attributes. The system enables the player to select one of the dealers for use in a play of the dealer-based game. During the play of the dealer-based game, the selected dealer deals the dealer-based game according to that dealer's card dealing attributes. In another embodiment, the system enables the player to create a custom dealer for use in a play of the dealer-based game by selecting one or more of the card dealing attributes. During that of the dealer-based game, the created custom dealer deals the dealer-based game according to that created custom dealer's card dealing attributes.

19 Claims, 20 Drawing Sheets

(56) References Cited

U.S. PATENT DOCUMENTS

| | | | | |
|---|---|---|---|---|
| 2004/0063482 | A1* | 4/2004 | Toyoda | 463/11 |
| 2005/0055114 | A1* | 3/2005 | Thomas | 700/91 |
| 2005/0071023 | A1 | 3/2005 | Gilliland et al. | |
| 2005/0096121 | A1 | 5/2005 | Gilliland et al. | |
| 2005/0170890 | A1* | 8/2005 | Rowe et al. | 463/42 |
| 2006/0079314 | A1* | 4/2006 | Walker et al. | 463/20 |
| 2006/0094493 | A1 | 5/2006 | Kido | |
| 2006/0170155 | A1 | 8/2006 | Silverman | |
| 2006/0199629 | A1 | 9/2006 | Sines et al. | |
| 2007/0049368 | A1 | 3/2007 | Kuhn et al. | |
| 2007/0060388 | A1* | 3/2007 | Stelzer et al. | 463/43 |
| 2007/0135203 | A1 | 6/2007 | Nicely | |
| 2007/0203971 | A1 | 8/2007 | Walker et al. | |
| 2008/0051176 | A1 | 2/2008 | Okada | |
| 2008/0076548 | A1 | 3/2008 | Paulsen | |
| 2008/0125219 | A1 | 5/2008 | Williams et al. | |
| 2008/0167103 | A1* | 7/2008 | Okada | 463/11 |
| 2008/0214262 | A1* | 9/2008 | Phillips et al. | 463/16 |
| 2008/0318668 | A1 | 12/2008 | Ching et al. | |
| 2009/0104961 | A1* | 4/2009 | Hamada et al. | 463/16 |
| 2009/0124385 | A1 | 5/2009 | Cuddy et al. | |
| 2009/0253503 | A1 | 10/2009 | Krise et al. | |
| 2009/0318222 | A1* | 12/2009 | Yoshizawa | 463/30 |
| 2010/0120536 | A1 | 5/2010 | Chatellier et al. | |
| 2010/0121808 | A1 | 5/2010 | Kuhn | |
| 2010/0148442 | A1 | 6/2010 | Walker et al. | |
| 2010/0227665 | A1 | 9/2010 | Nicely | |

* cited by examiner

GAMING SYSTEM, GAMING DEVICE, AND METHOD PROVIDING PLAYER-SELECTABLE CARD DEALING ATTRIBUTES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Various commercially available gaming devices enable a player to select a video, graphical, or virtual dealer for a dealer-based game, such as a card game, from a set or group of video, graphical, or virtual dealers having different appearances. That is, each of the video, graphical, or virtual dealers in the set or group look different from one another. These gaming devices display the selected video, graphical, or virtual dealer manipulating one or more objects during play of the dealer-based game. In one of these gaming devices configured to operate a video blackjack game, the gaming device displays the selected video, graphical, or virtual dealer dealing cards to players. In another one of these gaming devices configured to operate a video roulette game, the gaming device displays the selected video, graphical, or virtual dealer introducing a ball into a roulette wheel.

Certain players make video, graphical, or virtual dealer selections based on emotional factors, such as familiarity, gender, attractiveness, or other aesthetic considerations. Other players change video, graphical, or virtual dealers to change the voice-over, as it may become irritating to keep hearing the same speech over and over. Other players enjoy having control of an aspect of the dealer-based game. Certain of these gaming devices enable a player to replace a current video, graphical, or virtual dealer with another one of the video, graphical, or virtual dealers having a different appearance. Some players believe that changing the appearance of the video, graphical, or virtual dealer may change the player's luck and render the player more likely to achieve a winning outcome or outcomes.

Part of the excitement of playing wagering games is the anticipation and revelation of outcomes during play of those wagering games. In dealer-based games including cards, the movement of a card from the deck to a player's area and the rotation of the card from face-down to face-up can have a large impact on a player's ability to detect, for example, the difference between a face card and non-face card prior to the card settling into its final position. Similarly, many players have certain expectations as to how card deals should look, and it can become annoying to certain of these players to try to carefully watch card movement that continually appears wrong to those players. This may detract from the player's enjoyment of the anticipation and revelation of outcomes during play of the game.

Since there are so many variables associated with the movement and timing in dealing a card from a deck or from a shoe, players can usually notice changes in deal pacing, card placement, and card reveal. For players who like to change their video, graphical, or virtual dealer throughout a play session to change their luck or for any other suitable reason, the fact that the deal itself never changes when the video, graphical, or virtual dealer changes can greatly reduce the psychological impact of the change. By having a never-changing card deal, it can become much harder for a given player to continue the player's suspension of disbelief regarding the reality of the dealer and the authenticity of the change of dealer.

Thus, while certain of the different video, graphical, or virtual dealers differ in appearance, for a given dealer-based game each of the video, graphical, or virtual dealers employs the same style of object manipulation, including the same timing, mechanics, and animations. Viewing a video, graphical, or virtual dealer using the same style of object manipulation for each play of a given dealer-based game in each gaming session leads to player boredom and monotonous game play. This may encourage players to stop playing the gaming device. Therefore, to increase player enjoyment, excitement, and retention, it is desirable to provide players with new ways to customize playing experiences and to provide players with a way to control certain aspects of the gaming device or the games operated thereon. A continuing need thus exists to provide new and exciting gaming systems, gaming devices, and methods employing customizable dealers for dealer-based games.

SUMMARY

The present disclosure provides various embodiments of a gaming system, gaming device, and method providing player selectable object manipulation attributes. In various embodiments, the gaming system enables a player to play one or more dealer-based games. The gaming system includes a plurality of different object manipulation attributes. In certain embodiments, the gaming system includes a plurality of different predetermined video, graphical, or virtual dealers (referred to herein as "dealers"), each of which is associated with one or more of the object manipulation attributes. In these embodiments, the gaming system enables the player to select one of the dealers for use in one or more plays of one or more of the dealer-based games. During those plays of the dealer-based games, the selected dealer operates the dealer-based games according to the selected dealer's object manipulation attributes. In certain other embodiments, the gaming system enables the player to create a custom dealer for use in one or more plays of one or more of the dealer-based games by selecting one or more of the object manipulation attributes. During those plays of the dealer-based games, the created custom dealer operates the dealer-based games according to that created custom dealer's object manipulation attributes.

It should thus be appreciated that the gaming systems, gaming devices, and methods of operating the gaming systems and gaming devices of the present disclosure enable a player to customize the manner in which dealer-based games are operated and presented to the player by either selecting a certain dealer associated with desired object manipulation attributes or by creating a custom dealer having desired object manipulation attributes.

In embodiments in which the dealer-based game is a card game, such as blackjack or poker, the object manipulation attributes are card dealing attributes. In one example, the card dealing attributes are: deal speed, deal direction, card face reveal animation, and shuffle animation. In this example, the gaming system includes a plurality of different deal speed attributes, a plurality of different deal direction attributes, a plurality of different card face reveal animation attributes, and a plurality of different shuffle animation attributes. Each dealer in this example is associated with one of each plurality of attributes. The gaming system displays the selected or custom created dealer operating the dealer-based game (e.g., dealing cards) in accordance with the card dealing attributes of that dealer.

Additional features and advantages are described herein, and will be apparent from, the following Detailed Description and the Figures.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
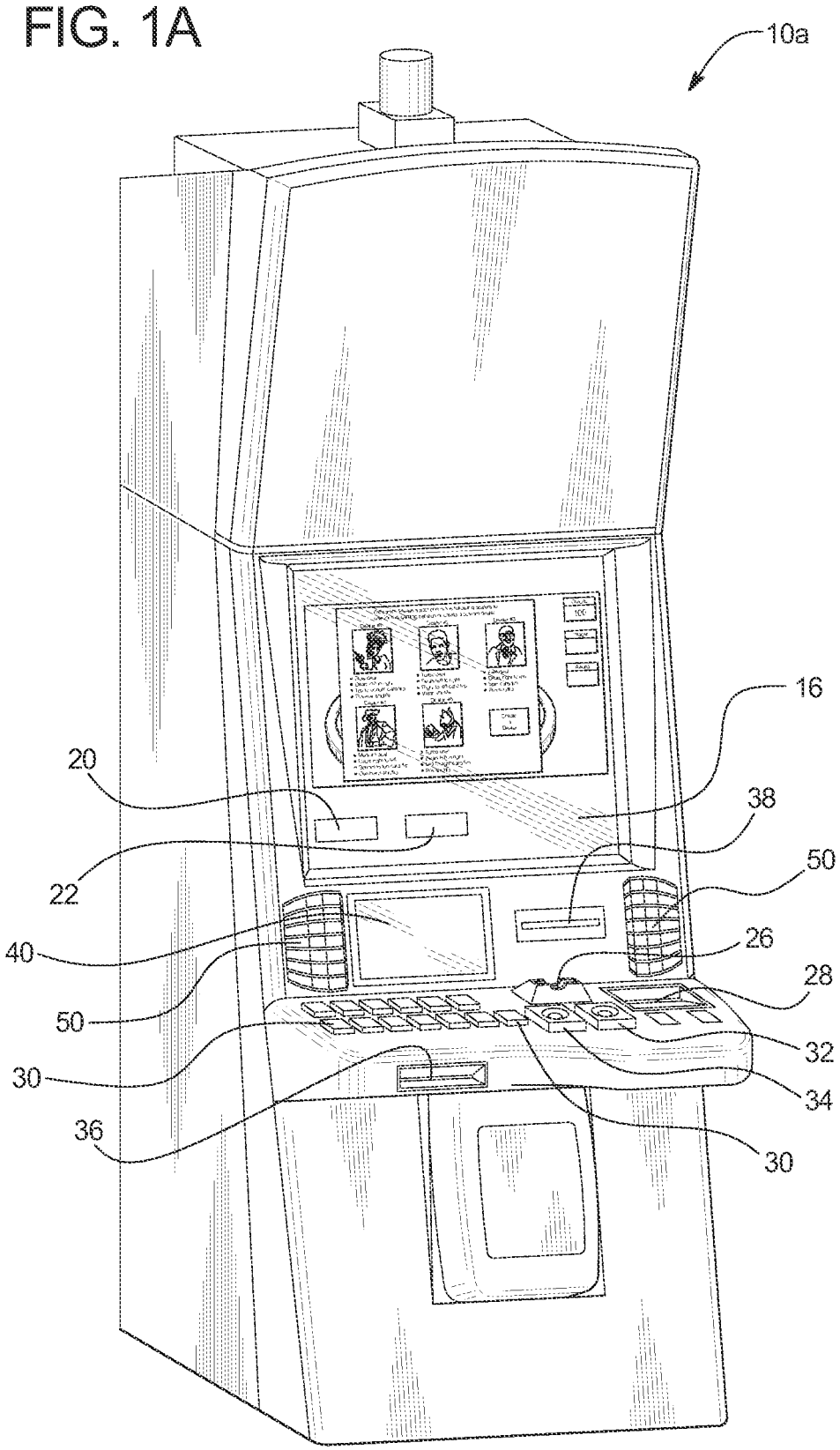
FIGS. 1A and 1B are perspective views of example alternative embodiments of the gaming device of the present disclosure.
Figure 1B:
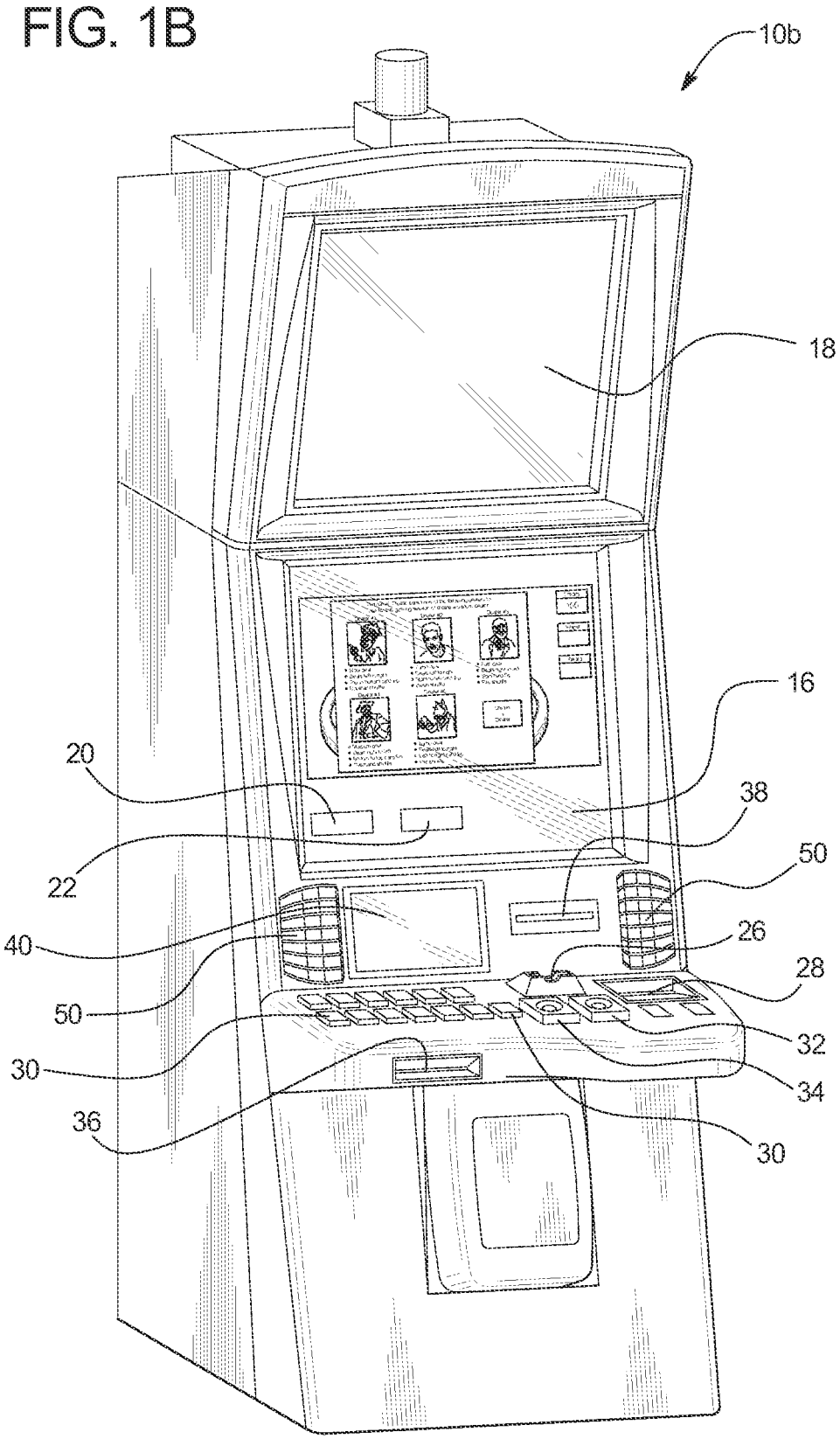

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate preferably while sitting. As illustrated by the different configurations shown in FIGS. 1A and 1B, the gaming device may have varying cabinet and display configurations.

Figure 2A:
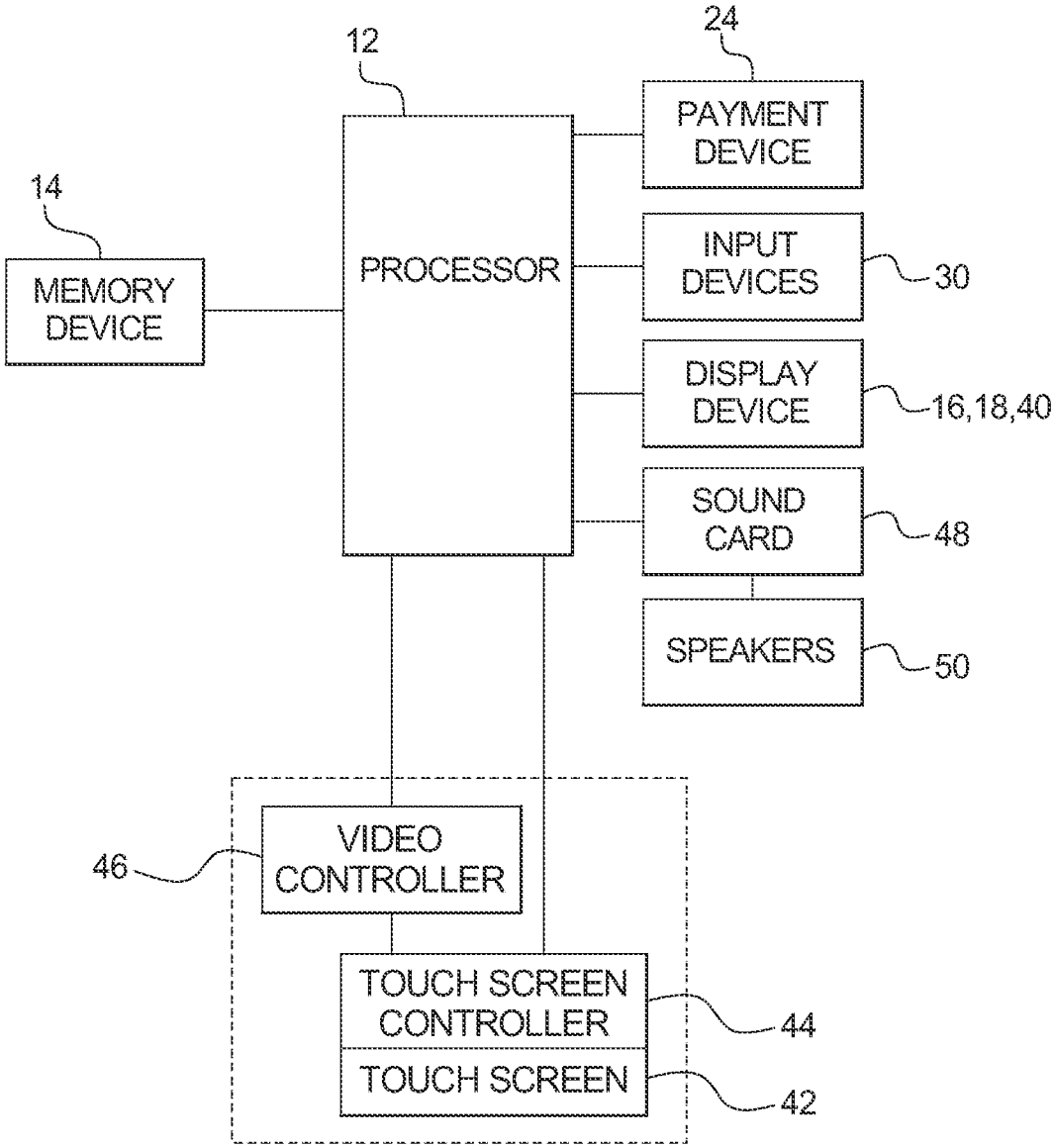
FIG. 2A is a schematic block diagram of one embodiment of an electronic configuration for one of the gaming devices disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, paytable data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM).

In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, non-transitory computer readable medium, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. It should be appreciated that at least one of the base or primary game and the secondary or bonus game is a dealer-based game. That is, at least one aspect of that dealer-based game (i.e., either or both of the base or primary game and the secondary or bonus game) is performed or controlled by a dealer. In the embodiments disclosed herein, the base or primary game is a dealer-based game (and referred to herein as the "base or primary dealer-based game"), while the secondary or bonus game may or may not be a dealer-based game. It should be appreciated that in certain embodiments the base or primary game is not a dealer-based game and the secondary or bonus game is a dealer-based game, and that in certain other embodiments both the base or primary game and the secondary or bonus game are dealer-based games. The gaming machine or device may include some or all of the features of conventional gaming machines or devices. The gaming device may incorporate any suitable reel-type game (as the secondary or bonus game), card game (as the base or primary dealer-based game or the secondary or bonus game), or other game of chance susceptible to representation in an electronic or electromechanical form that in one embodiment produces a random outcome based on probability data at the time of or after placement of a wager. That is, different base or primary dealer-based games or secondary or bonus games, such as video poker games, video blackjack games, video keno games, and video bingo games, may be implemented.

In one embodiment, the secondary or bonus game is a non-dealer-based game that includes one or more paylines associated with a plurality of symbol display positions. The paylines may be horizontal, vertical, circular, diagonal, angled, or any combination thereof. In this embodiment, the gaming device includes at least one and preferably a plurality of reels, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, the base or primary dealer-based game or the secondary or bonus game may be a poker game wherein the gaming device enables the player to play a conventional game of video draw poker. A video, graphical, or virtual dealer initially deals five cards all face up from a virtual deck of fifty-two cards. The video, graphical, or virtual video, graphical, or virtual dealer deals the cards in accordance with card dealing attributes associated with the dealer, as explained in detail below. The dealt cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the video, graphical, or virtual dealer deals the replacement cards from the remaining cards in the deck according to the card dealing attributes associated with the video, graphical, or virtual dealer. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary dealer-based game or the secondary or bonus game may be a multi-hand version of video poker. In this embodiment, a video, graphical, or virtual dealer deals the player at least two hands of cards in accordance with card dealing attributes associated with the video, graphical, or virtual dealer, as explained further below. In one such embodiment, each of the hands of cards is the same. In one embodiment each hand of cards is associated with its own deck of cards. The player chooses the cards to hold in a primary hand. The held cards in the primary hand are also held in the other hands of cards. The remaining non-held cards are removed from each hand displayed and for each hand the video, graphical, or virtual dealer deals random replacement cards into that hand in accordance with the card dealing attributes associated with the dealer, as explained in detail below. Since the replacement cards are randomly dealt independently for each hand, the replacement cards for each hand will usually be different. The poker hand rankings are then determined hand by hand against a payout table and awards are provided to the player.

In one embodiment, the secondary or bonus game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, as noted above, in addition to winning credits or other awards in the base or primary dealer-based game, the gaming device may also give players the opportunity to win credits in a secondary or bonus game or in a secondary or bonus round. The secondary or bonus game enables the player to obtain a prize or payout in addition to the prize or payout, if any, obtained from the base or primary dealer-based game. In general, a secondary or bonus game produces a significantly higher level of player excitement than the base or primary dealer-based game because it provides a greater expectation of winning than the base or primary dealer-based game, and is accompanied with more attractive or unusual features than the base or primary dealer-based game. In one embodiment, the secondary or bonus game may be any type of suitable game, either similar to or completely different from the base or primary dealer-based game.

In one embodiment, the triggering event or qualifying condition may be a selected outcome in the base or primary dealer-based game or a particular arrangement of one or more indicia on a display device in the base or primary dealer-based game, such as a BONUS card being dealt to a player in the base or primary dealer-based game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary dealer-based game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary dealer-based game.

In one embodiment, the gaming device includes a program that will automatically begin a secondary or bonus round after the player has achieved a triggering event or qualifying condition in the base or primary dealer-based game. In another embodiment, after a player has qualified for a secondary or bonus game, the player may subsequently enhance the player's secondary or bonus game participation through continued play of the base or primary dealer-based game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary dealer-based game may result in an arithmetic or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary dealer-based game, thus encouraging play of the base or primary dealer-based game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary dealer-based game to qualify for the secondary or bonus game. In this embodiment, the secondary or bonus game triggering event must occur and the side-wager (or designated base or primary dealer-based game wager amount) must have been placed to trigger the secondary or bonus game.

Figure 2B:
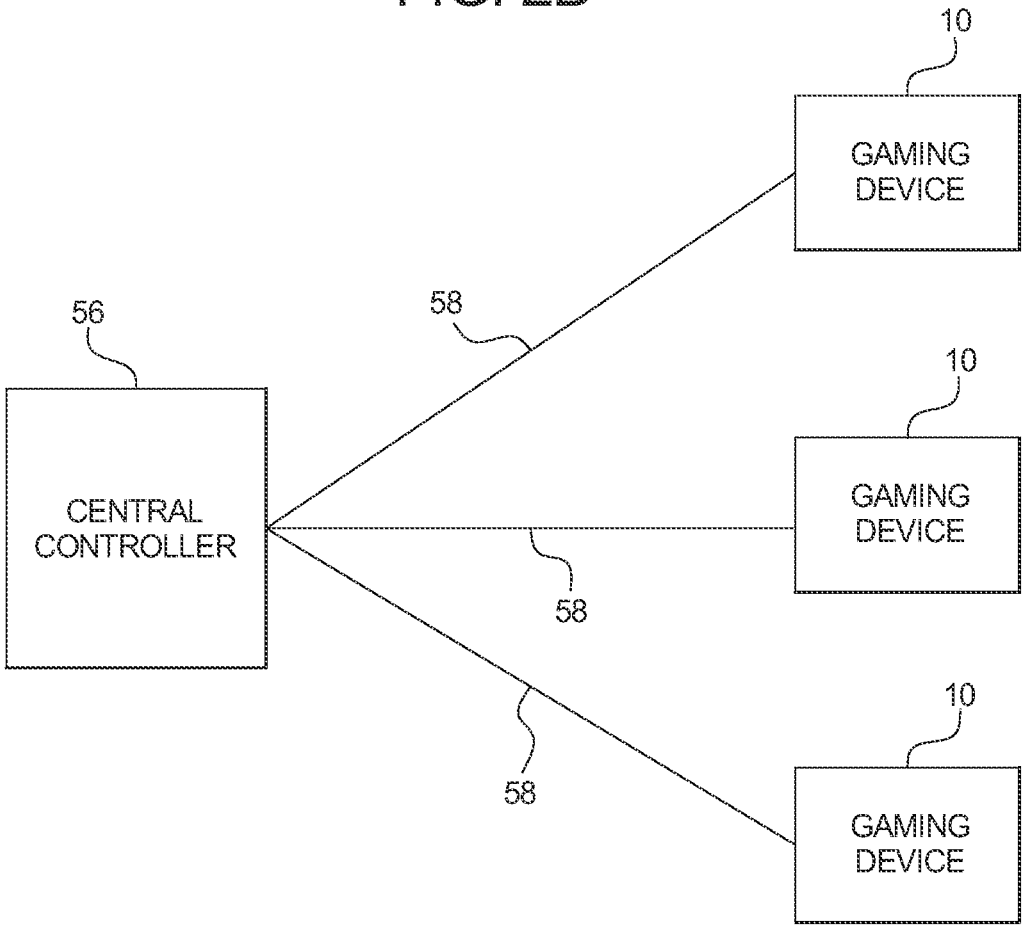
FIG. 2B is a schematic block diagram of one embodiment of a network configuration for a plurality of gaming devices disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary dealer-based game based on probability data. In another embodiment, the central server or controller randomly generates a game outcome for the secondary or bonus game based on probability data. In another embodiment, the central server or controller randomly generates a game outcome for both the base or primary dealer-based game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary dealer-based game outcome, a secondary or bonus game outcome, base or primary dealer-based game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary dealer-based game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary dealer-based game, a secondary or bonus game, or both. In another embodiment, the game program may be executable as a secondary or bonus game to be played simultaneous with the play of the base or primary dealer-based game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary dealer-based game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary dealer-based game. That is, a player is provided a progressive award without any explanation or, alternatively, with simple explanations. In another embodiment, a player is provided a progressive award at least partially based on a game triggered or symbol triggered event, such as at least partially based on the play of the base or primary dealer-based game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary dealer-based game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the base or primary dealer-based game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary dealer-based game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group.

In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Player-Selectable Card Dealing Attributes

The present disclosure provides various embodiments of a gaming system, gaming device, and method providing player selectable object manipulation attributes (sometimes referred to herein as the "gaming system," "gaming device," or "method"). In various embodiments, the gaming system enables a player to play one or more dealer-based games. The gaming system includes a plurality of different object manipulation attributes. In certain embodiments, the gaming system includes a plurality of different predetermined video, graphical, or virtual dealers (referred to herein as "dealers"), each of which is associated with one or more of the object manipulation attributes. In these embodiments, the gaming system enables the player to select one of the dealers for use in one or more plays of one or more of the dealer-based games. During those plays of the dealer-based games, the selected dealer operates the dealer-based games according to the selected dealer's object manipulation attributes. In certain other embodiments, the gaming system enables the player to create a custom dealer for use in one or more plays of one or more of the dealer-based games by selecting one or more of the object manipulation attributes. During those plays of the dealer-based games, the created custom dealer operates the dealer-based games according to that created custom dealer's object manipulation attributes. It should thus be appreciated that the gaming systems, gaming devices, and methods of operating the gaming systems and gaming devices of the present disclosure enable a player to customize the manner in which dealer-based games are operated and presented to the player by either selecting a certain dealer associated with desired object manipulation attributes or by creating a custom dealer having desired object manipulation attributes.

It should thus be appreciated that the object manipulation attributes associated with a given selected dealer or created custom dealer control how that dealer operates the dealer-based game during play (i.e., controls how operation of the dealer-based game is displayed). It should be appreciated that any suitable object manipulation attributes may be employed. For example, in various embodiments employing a video card game such as blackjack, the object manipulation attributes are card dealing attributes. In certain of these embodiments, each of the dealers is associated with at least one of the following card dealing attributes: (a) one of a plurality of different deal speed attributes, each of which is associated with a different speed at which the cards are dealt (e.g., slow, medium, fast, or turbo); (b) one of a plurality of different deal direction attributes, each of which is associated with a different direction in which the cards are dealt (e.g., left to right or right to left); (c) one of a plurality of different card reveal animation attributes, each of which is associated with a different animation by which the face of each card is revealed (e.g., flip left to right, flip right to left, flip top to bottom, flip bottom to top, spin flip); and (d) one of a plurality of different shuffle animation attributes, each of which is associated with a different animation by which the cards are shuffled (e.g., riffle or dovetail shuffle, stripping or overhand shuffle, pile shuffle, wash shuffle).

In various embodiments, each of the dealers is associated with one or more of the following card dealing attributes: (a) a specific time between initiation of a play of the dealer-based game and start of the deal, (b) a specific time it takes a card to move from a deck or shoe to the player's position, (c) a specific time at which the player can see the card start to turn over, (d) a specific amount of time it takes for the card to turn over, (e) a specific interrelationship between the time when card is turned over to the time when card stops moving, (f) a specific time between player input for an additional card the start of the deal of that card, (g) a specific time for a face-down card deal versus a card-turn-over deal, (h) a specific time between consecutive cards dealt to the same player, (i) a specific time between consecutive cards dealt between players, (j) a specific time between consecutive cards dealt to the dealer, (k) a specific time between consecutive cards dealt to a community card area of the table, (l) a specific time required to turn over an already dealt card, (m) a specific time between the consecutive turning over of already dealt cards, (n) a specific time between player action and the start of turning over an already dealt card, (o) a specific time it takes to clear or otherwise remove cards from a hand mid-game, (p) a specific time it takes to clear or otherwise remove cards from a hand at the end of a game, (q) a specific time it takes to clear or otherwise remove cards from all hands at the end of the game, (r) a specific time it take to deal a special card such as a card dealt in response to a double player request in blackjack, and (s) a specific time it takes to reposition cards mid game such as in response to a split player request in blackjack.

In some embodiments employing a video roulette game, the object manipulation attributes are roulette dealer attributes. In certain of these embodiments, each of the dealers is associated with at least one of the following roulette dealer attributes: (a) one of a plurality of ball launch direction attributes (e.g., clockwise or counter-clockwise); (b) one of a plurality of ball launch speed attributes (e.g., slow, medium, or fast); (c) one of a plurality of directions of roulette wheel rotation (e.g., clockwise or counter-clockwise); (d) one of a plurality of positions within the bowl of the roulette wheel where the ball launch starts; (e) a specific amount of hand movement associated with the launch of the ball; (f) a specific type of hand positioning with the launch of the ball; (g) a specific slow-down, if any, of the roulette wheel after a result occurs; (h) a specific slow-down or stopping of the roulette wheel, if any, when the ball is removed from the roulette wheel well in which it landed; (i) a specific amount of time between the ball landing in its final well and the dealer announcing or otherwise signaling that the result is final; (j) a specific signaling that a betting round is closed and no new bets may be placed; (i) a specific signaling that the close of the betting round is soon to occur; (k) a specific time between the signaling that of the betting round is about to close and the signaling that the betting round has closed; (l) a specific timing of the movement of the win marker to the winning position; (m) a specific timing of the removal of losing chips; (n) a specific movement of the removal of winning chips; (o) a specific timing of the presentation of chips to winning players; and (p) a specific variability of any of the preceding factors (for example, on a given play of the roulette game a first dealer will wait a random amount of time between 1.2 seconds and 1.6 seconds between the ball landing in its final well and the announcement of the result while a second dealer on a different given play of the roulette game will always wait 1.4 seconds between the ball landing in its final well and the announcement of the result).

As explained above, in various embodiments the gaming system includes a set or group of a plurality of different predetermined dealers. Each of the dealers has an certain appearance and is associated with one or more of the object manipulation attributes, which are in some embodiments independent of the dealers' appearances. A dealer's appearance is, in general, what the dealer looks like. For example, the dealer's appearance may include a variety of elements and/or characteristics, such as (but not limited to): clothing color; clothing style; hair color; hair style; eye color; clothing accessories (e.g., bows or belts); makeup; stature (e.g., short, tall, or average height); body type (e.g., endomorphic, mesomorphic, or exomorphic); body shape (e.g., thin, buxom, or muscular); facial shape; skin color; skin reflectivity; jewelry; sex (i.e., male or female); voice (e.g., high-pitched, low-pitched); speech content; and species (e.g., human, dog, cat, robot). Each dealer differs from each of the other dealers in appearance and/or object manipulation attributes. In one example in which the dealer-based game is a card game, two dealers have the same appearance but at least one different card dealing attribute (e.g., one has the slow deal timing attribute while the other has the fast deal timing attribute). In another example, two dealers have the same card dealing attributes but different appearances (e.g., one is a female dealer and the other is a male dealer). In another example, two dealers have different appearances (e.g., one is a female dealer and the other is a male dealer) and at least one different card dealing attribute (e.g., one has the slow deal timing attribute while the other has the fast deal timing attribute).

In certain embodiments, one or more object manipulation attributes are associated with a certain characteristic of dealer appearance. In other words, in these embodiments at least one object manipulation attribute of a given dealer depends upon one or more aspects of the dealer's appearance. In one example in which the dealer-based game is a card game, the shuffle animation attribute may be tied to the species of the dealer. For instance, when the species is a dog, the shuffle animation attribute may be the dealer burying and digging up the cards.

The gaming system enables the player to select one of the plurality of different predetermined dealers for use in one or more plays of one or more of the dealer-based games. It should be appreciated that the gaming system displays or otherwise indicates the object manipulation attributes of each of the dealers when the gaming system enables the player to select a dealer so as to enable the player to differentiate among the dealers and customize game play to the player's liking. After receiving a selection of a dealer from the player, the gaming system operates one or more plays of the dealer-based game or games in accordance with the selected dealer. That is, the gaming system displays one or more plays of the dealer-based game or games being operated according to the object manipulation attributes of the selected dealer.

In certain embodiments, the gaming system enables the player to create a custom dealer for use in one or more plays of one or more of the dealer-based games. Specifically, the gaming system enables the player to select one or more of the object manipulation attributes (such as those described above) and, in certain embodiments, one or more aspects of appearance. The gaming system operates one or more plays of the dealer-based game or games in accordance with the created custom dealer. That is, the gaming system displays one or more plays of the dealer-based game or games being dealt according to the object manipulation attributes of the created custom dealer.

In some embodiments, the gaming system prompts the player to select one of the dealers or to create a custom dealer when the player begins a gaming session (e.g., when the player deposits currency into the gaming system). In various embodiments, the gaming system enables the player to change the dealer by either selecting a new dealer (i.e., another one of the predetermined dealers or a previously created custom dealer) or creating a new custom dealer.

In various embodiments, the gaming system employs a predetermined dealer upon initiation of a gaming session and until a triggering condition is met. When the triggering condition is met, the gaming system enables the player to change the predetermined dealer by selecting one of the plurality of different predetermined dealers or creating a custom dealer, depending upon the embodiment. It should thus be appreciated that, in certain embodiments, the player must perform a certain action or actions or reach a certain threshold or thresholds in order for the gaming system to enable the player to change dealers or create a new custom dealer. In various examples: (a) the triggering condition is met when the player indicates that the player wishes to select a dealer or create a custom dealer (thus, the player directly controls when the triggering condition is met and when the gaming system enables the player to select a dealer or create a custom dealer); (b) the triggering condition is met upon the expiration of a period of time; (c) the triggering condition is met after the player has played a designated quantity of plays of the dealer-based game or games; (d) the triggering condition is met after the player has lost (i.e., has not achieved a winning outcome) in any of designated quantity of consecutive plays of the dealer-based game or games; (e) the triggering condition is met after the player has lost a designated amount of currency or credits in the dealer-based game or games; (f) the triggering condition is met when the player places an additional wager or pays a predetermined fee; (g) the triggering condition is met when the player achieves a certain player loyalty status associated with a player tracking account; (h) the triggering condition is met when the player achieves a certain outcome or outcomes during play of the dealer-based game; (i) the triggering condition is met when the player achieves a designated amount of winnings during play of the dealer-based game; (j) the triggering condition is met when the player achieves a designated quantity of one or more designated outcomes during play of the dealer-based game; (k) the triggering condition is met when the player has initiated a designated quantity of gaming sessions of the dealer-based game; and (l) any suitable combination thereof. It should be appreciated that any suitable triggering condition may be employed.

Similarly, in various embodiments, certain special dealers or special object manipulation attributes only become available to a player for selection during dealer selection or dealer customization upon the occurrence of a triggering event, such as any of the triggering events described above. It should be appreciated that, in general, these (initially) withheld special dealers or special object manipulation attributes are more desirable to players. In some embodiments, certain of these special dealers benefit players during play of the dealer-based game. In one example where the dealer-based game is a card game, one of these special dealers deals only face cards. In another example, one of these special dealers uses a deck that includes wild cards. In another example, one of these special dealers uses a deck that includes cards of only one suit. It should be appreciated that a special dealer may be tied to any suitable advantage, bonus, or other special feature that may be provided to the player. It should also be appreciated that, in certain embodiments, these special dealers or special object manipulation attributes may last for a limited period of time or quantity of plays so as to not provide the player with a perpetual advantage.

In some embodiments that utilize a set of predetermined dealers, the gaming system limits a player's ability to change dealers by enabling the player to select a dealer from a subset of the entire set of predetermined dealers. In these embodiments, the gaming system enables the player to pick each dealer in the subset of dealers one time. Once the player has picked each dealer in the subset of dealers, the gaming system provides the player with a new subset of dealers, and the process repeats.

In certain embodiments, the gaming system displays the selected dealer or created custom dealer (referred to herein collectively as the "dealer") to the player during play of the dealer-based game or games. For example, in some embodiments the gaming system displays a graphical animated representation of the dealer (such as an animated male or female human being) on a display device. In other embodiments, the gaming system displays a prerecorded video representation of the dealer. It should be appreciated that, in these embodiments, any suitable representation of the dealer may be displayed to the player, such as an image, a video, an illustration, or an animation. In certain other embodiments, the gaming system does not display the dealer to the player during play of the dealer-based game or games. In these embodiments, the dealer-based game is operated as if dealt by an invisible or phantom dealer, though it should be appreciated that the game is operated according to the object manipulation attributes of the dealer. It should be appreciated that the gaming system may enable the player to choose whether to display or not display a representation of the dealer.

In embodiments in which the gaming system includes a player tracking system, the selected or created custom dealer may be stored in association with the player's player tracking account. This enables the gaming system to employ the selected or created dealer (or enable the player to choose whether to employ the selected or created dealer) upon initiation of a different gaming session at a subsequent point in time. This also enables a player to craft a custom dealer over a large number of gaming sessions and attempt to create the player's "ideal" dealer. The player may accumulate various dealer appearance features (such as different hats; different jewelry; the ability to add, change, or remove various articles of clothing; different hairstyles; different nail polish; etc.), various object manipulation attributes (such as the special object manipulation attributes discussed above or additional "standard" object manipulation attributes, like different card shuffling animation attributes or card reveal animation attributes), and/or various other "upgrades." The player may use some or all of those to create a custom dealer or add features to an already-created custom dealer.

It should be appreciated that the gaming system may employ any suitable dealer-based game or games. For example, in various embodiments, the gaming system enables the player or players to play one or more of the following dealer-based games: (a) video poker, (b) video multi-player poker (such as Texas Hold'em), (c) video player versus casino card games (such as Pai Gow Poker or Three Card Poker), (d) video player versus a paytable card games, (e) video blackjack, (f) video bridge, (g) video Hearts, (h) video Spades, (i) video Baccarat, (j) video War, (k) any other suitable video card game, (l) video roulette, (m) video craps, (n) video high-low, and (o) video Money Wheel.

FIGS. 3A, 3B, 3C, 3D, 3E, and 3F illustrate screen shots of an example embodiment of a gaming system, gaming device, and method of operating the gaming system and gaming device. In this example, the dealer-based game is a blackjack game. Accordingly, the object manipulation attributes are card dealing attributes in this example. In this embodiment, the gaming system includes a plurality of different predetermined dealers, each of which has an appearance and is associated with one or more of the card dealing attributes. Upon initiation of a gaming session, the gaming system enables a player to select one of the dealers for use in one or more plays of a dealer-based game or create a custom dealer for use in one or more plays of the dealer-based game.

Figure 3A:
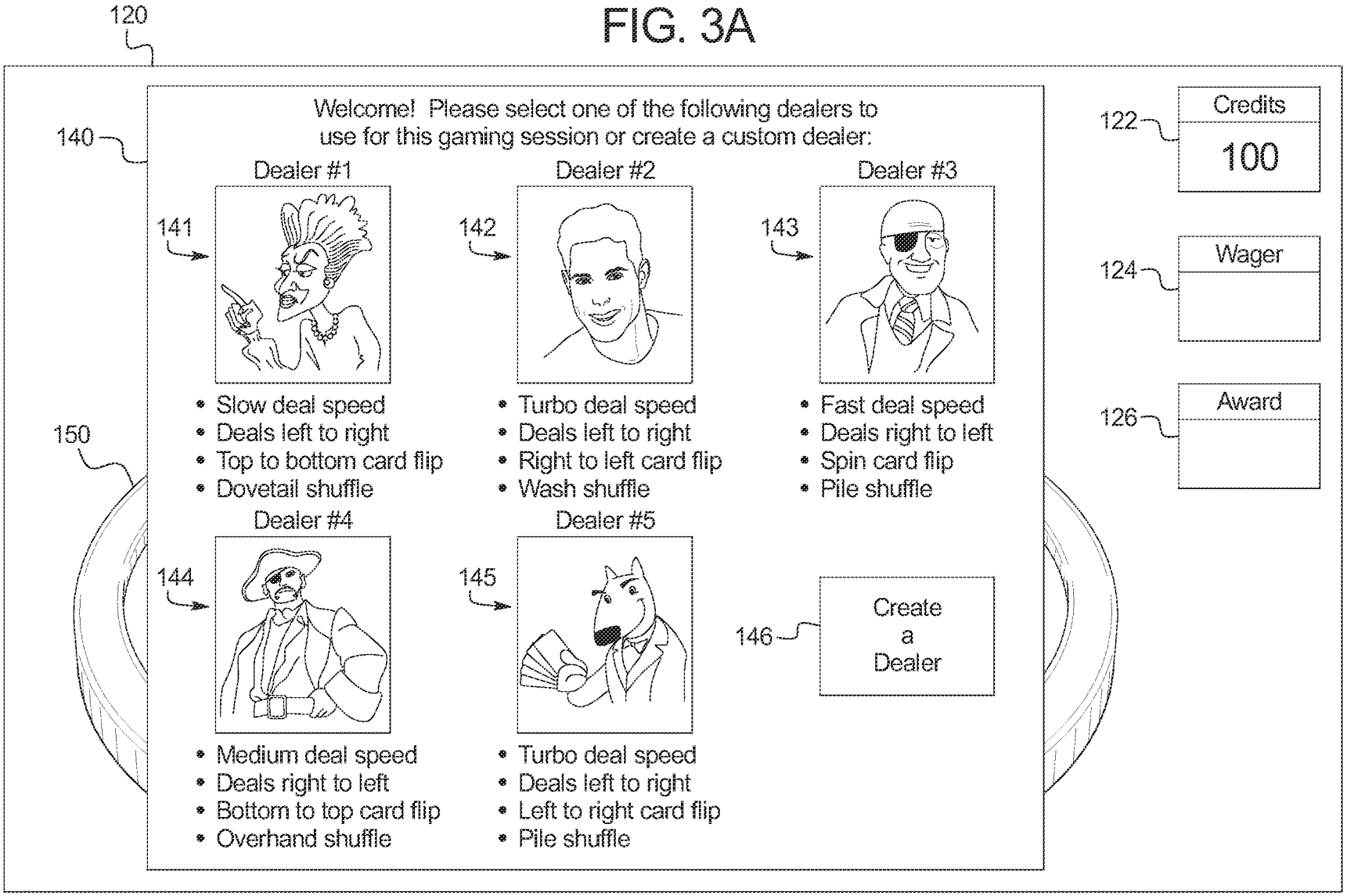
FIGS. 3A, 3B, 3C, 3D, 3E, and 3F are front views of a display device of an example gaming system or gaming device of one embodiment the present disclosure, and illustrate a player's selection of a dealer and a play of a dealer-based game in accordance with the card dealing attributes of the selected dealer.

As illustrated in FIG. 3A, a player has initiated a gaming session by depositing 100 credits into the gaming system. The player's credits are displayed by a display device 120 in a credit meter 122. Display device 120 also includes a wager meter 124, which displays any wager placed by the player for a play of the blackjack game, and an award meter 126, which displays any award or awards won by the player for a play of the blackjack game. Upon initiation of the gaming session, display device 120 displays an indication box 140, which includes a message welcoming the player and directing the player to either: (a) select one of five different dealers Dealer 1 141, Dealer 2 142, Dealer 3 143, Dealer 4 144, or Dealer 5 145 (referred to herein as Dealers 1, 2, 3, 4, and 5 for clarity and brevity); or (b) indicate that the player wishes to create a custom dealer by actuating CREATE A DEALER button 146. While in this embodiment the gaming system enables the player to select one of five dealers, it should be appreciated that in other embodiments the gaming system enables the player to select from any suitable quantity of dealers. It should also be appreciated that the gaming system enables the player to select one of the dealers in any suitable manner, such as by actuating a dedicated button or touching a designated area of a touch screen.

More specifically, indication box 140 includes an illustration, picture, or animation of each dealer and a plurality of card dealing attributes associated with each dealer. Dealer 1 has the appearance of an elderly woman with long hair, and includes the following card dealing attributes: slow deal speed, left to right deal direction, top to bottom card flip card face reveal, and dovetail card shuffle. Dealer 2 has the appearance of a young man with short hair, and includes the following card dealing attributes: turbo deal speed, left to right deal direction, right to left card flip card face reveal, and wash card shuffle. Dealer 3 has the appearance of an elderly man with an eye patch, and includes the following card dealing attributes: fast deal speed, right to left deal direction, spin card flip card face reveal, and pile card shuffle. Dealer 4 has the appearance of a pirate, and includes the following card dealing attributes: medium deal speed, right to left deal direction, bottom to top card flip card face reveal, and overhand card shuffle. Dealer 5 has the appearance of a dog, and includes the following card dealing attributes: turbo deal speed; left to right deal direction, left to right card flip card face reveal, and pile card shuffle.

Figure 3B:
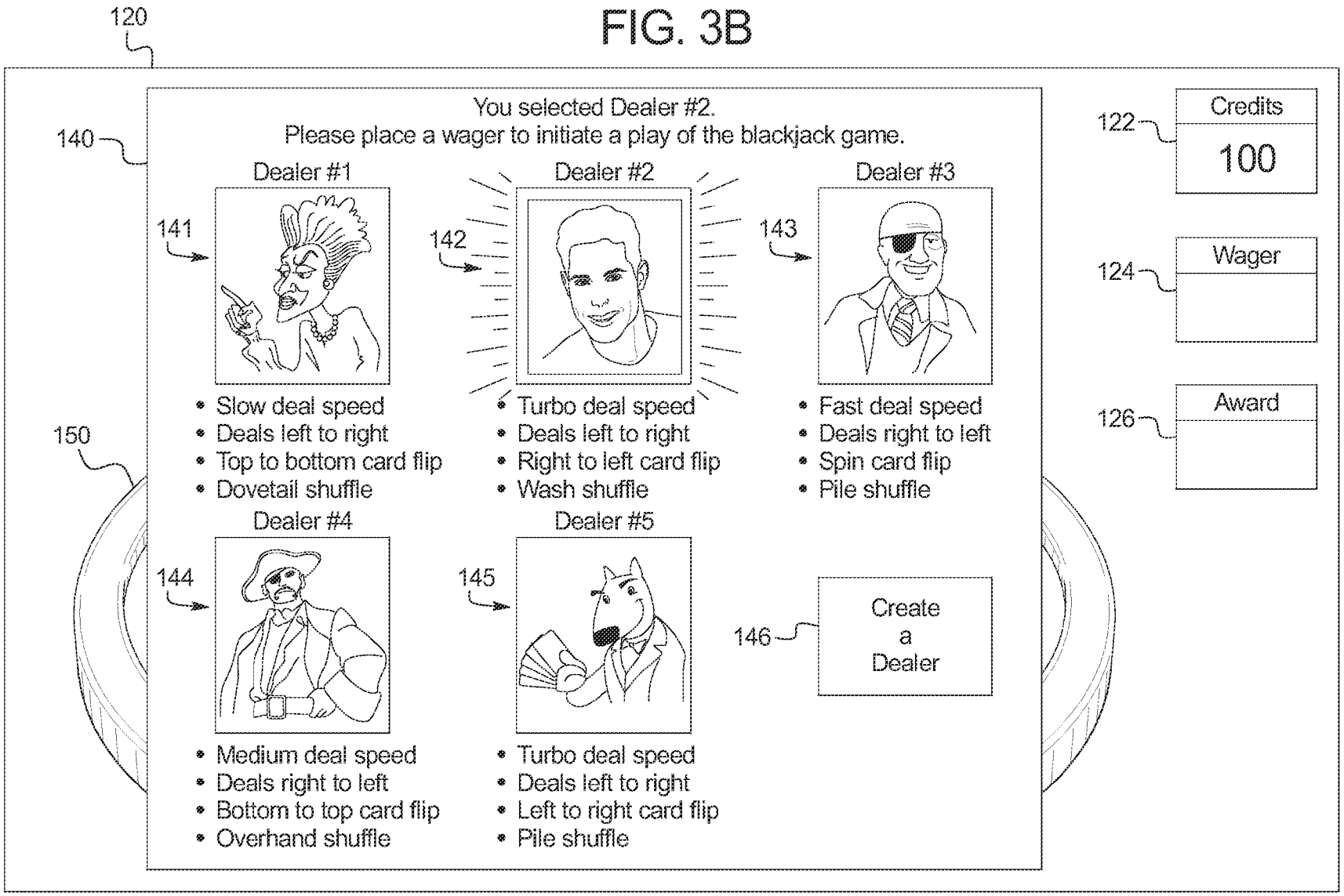

As illustrated in FIG. 3B, the player selects Dealer 2 for use in the blackjack game. Indication box 140 displays a notification asking the player to place a wager to initiate a play of the blackjack game.

Figure 3C:
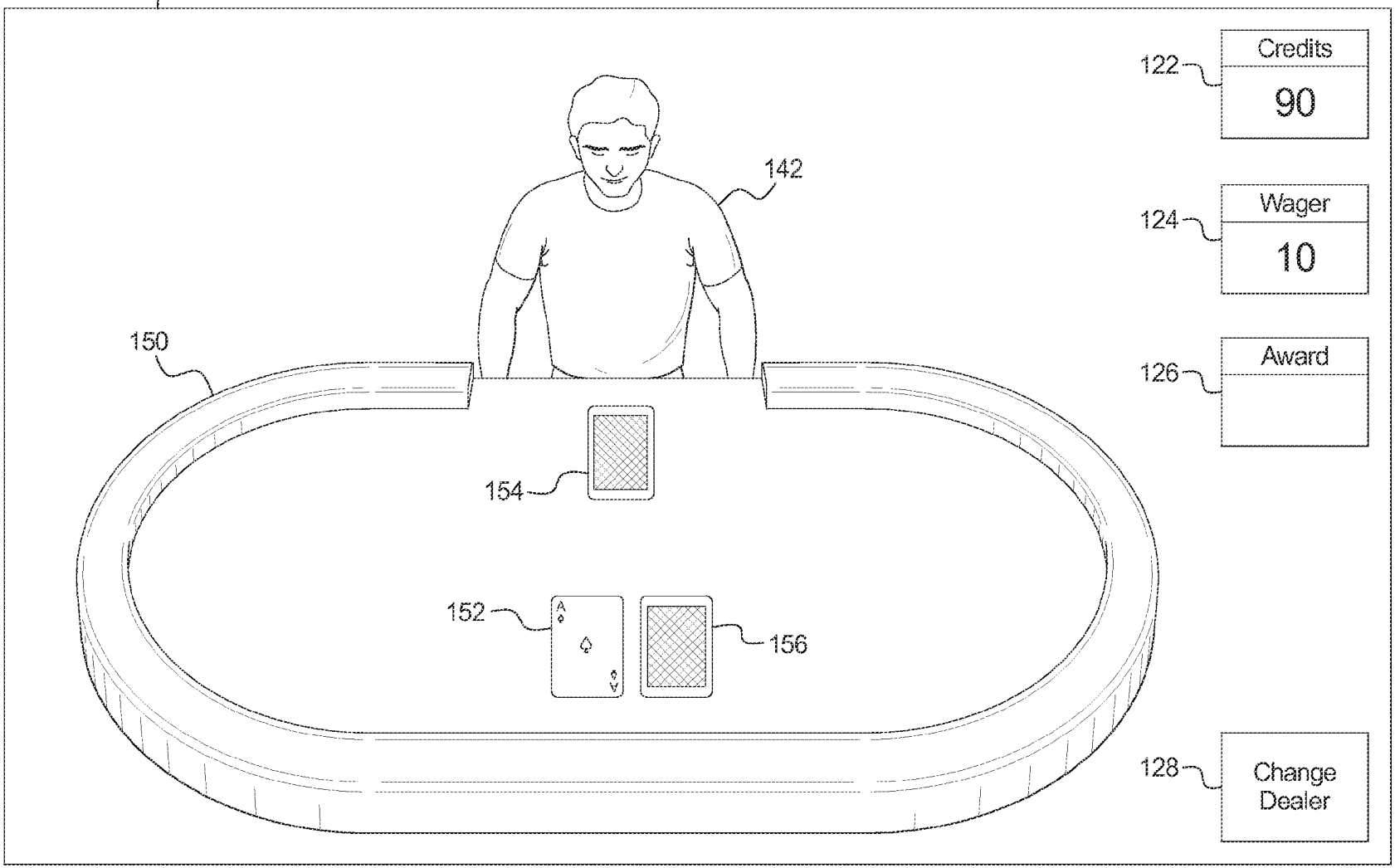
Figure 3D:
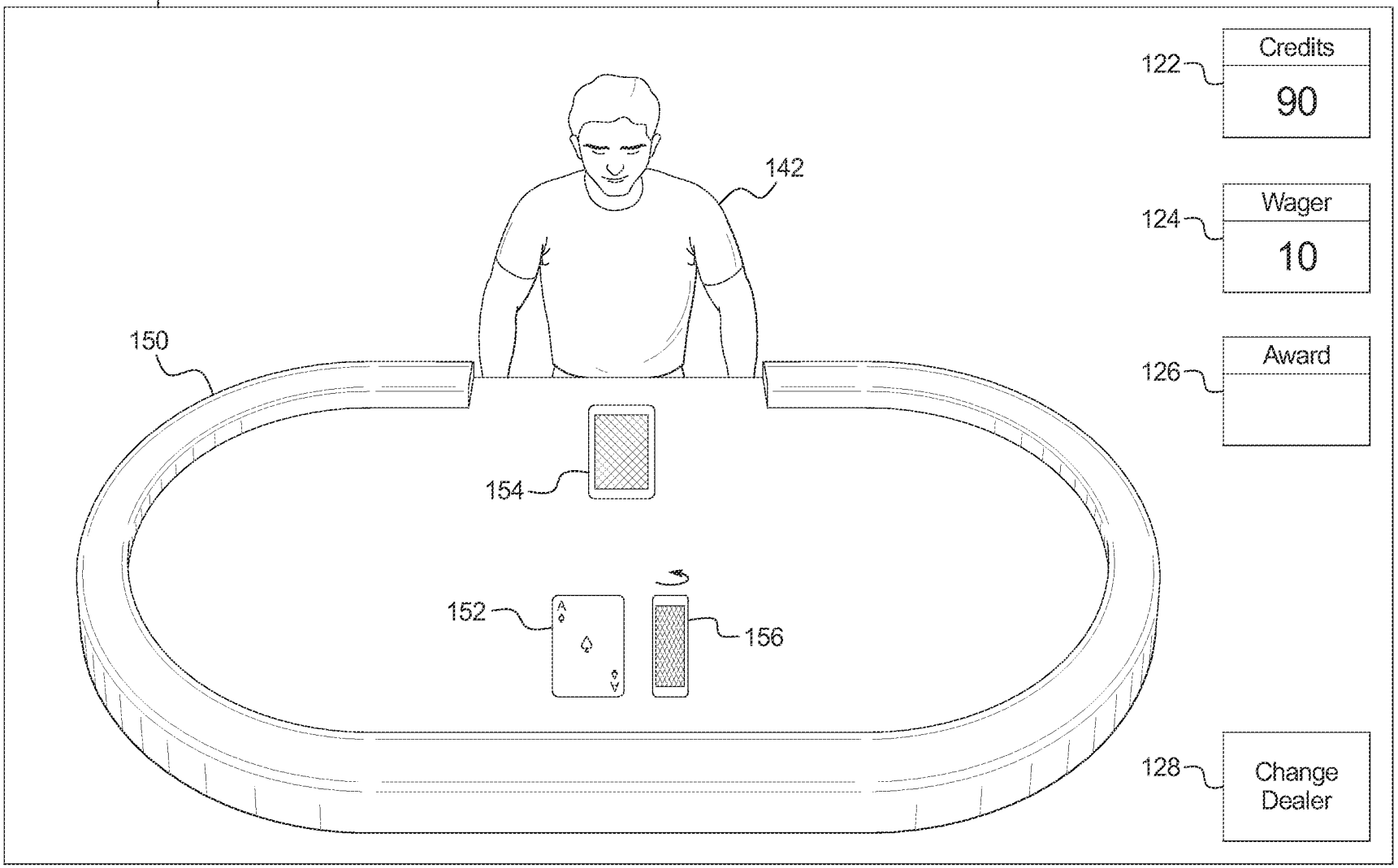
Figure 3E:
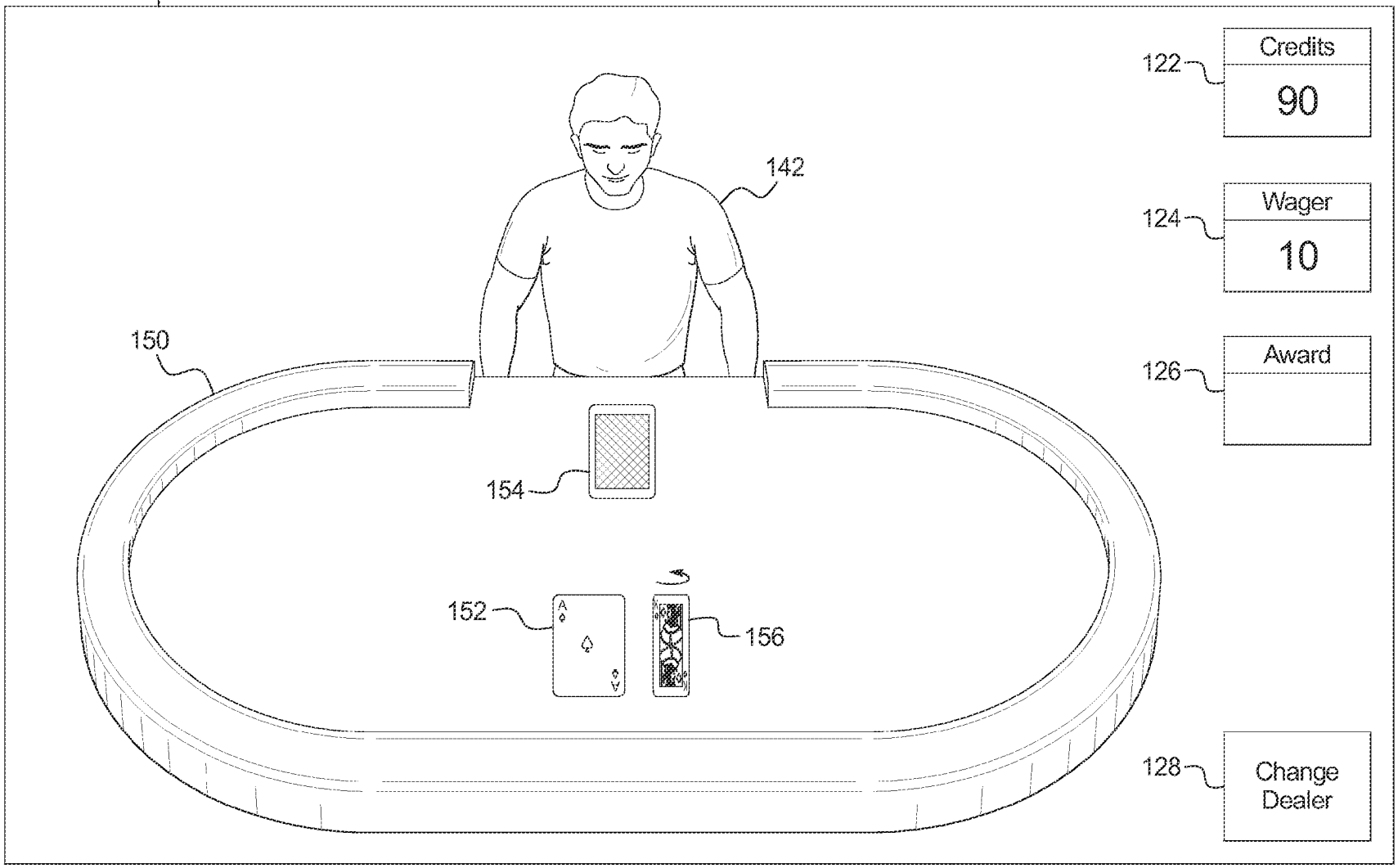
Figure 3F:
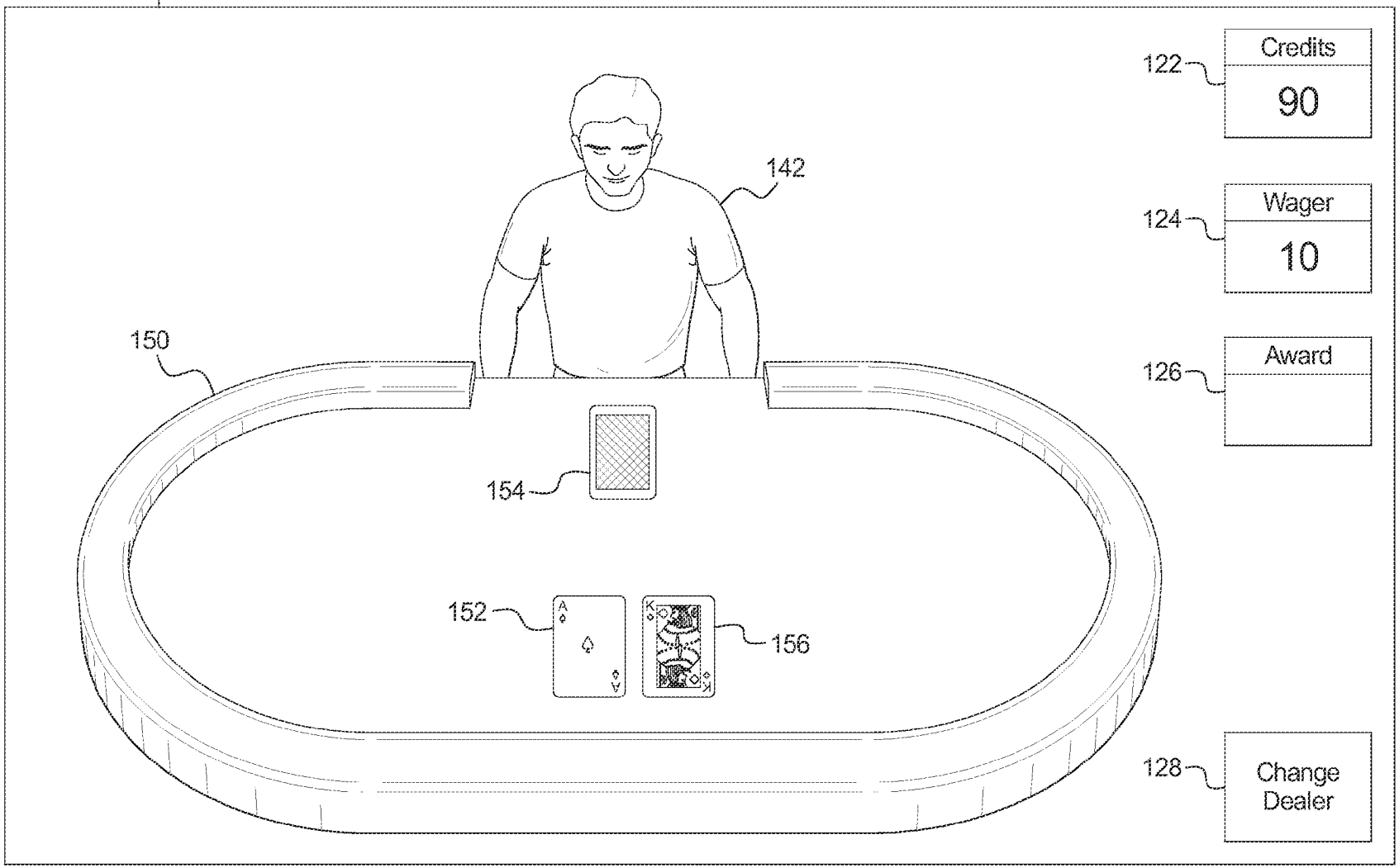

As illustrated in FIG. 3C, the gaming system received a wager of ten credits for a play of the blackjack game. Wager meter 124 displays the ten credit wager, and credit meter 122 displays the player's credit balance of ninety credits, which reflects the player's initial credit balance of 100 credits minus the player's wager of ten credits. Upon initiation of the play, display device 120 displays Dealer 2 (which was selected by the player) on one side of a game table 150. The gaming system displays Dealer 2 shuffling and dealing cards of the blackjack game in accordance with the following card dealing attributes of Dealer 2: turbo deal speed, left to right deal direction, right to left card flip card face reveal, and wash card shuffle.

Specifically, as illustrated in FIGS. 3C, 3D, 3E, and 3F, display device 120 displays Dealer 2 dealing and revealing a first player card 152 to the player, then dealing a face down first dealer card 154 to Dealer 2, and then dealing and beginning to reveal a second player card 156 to the player. First player card 152, which was dealt first, is positioned to the left of second player card 156, which was subsequently dealt. Thus, Dealer 2 deals from left to right in accordance with the deal direction attribute of Dealer 2. Additionally, as illustrated in the progression of FIGS. 3C to 3F, Dealer 2 reveals the faces of the cards (which are initially dealt face down) by flipping the cards from right to left, as illustrated in association with second player card 156 and in accordance with the card reveal animation attribute of Dealer 2.

In this embodiment, display device 120 displays a CHANGE DEALER button 128. The gaming system enables the player to actuate CHANGE DEALER button 128 during play of the blackjack game. When the player actuates CHANGE DEALER button 128, the gaming system enables the player to select a different dealer or create a dealer for use in one or more plays of the blackjack game.

In other embodiments, rather than including dealers with predetermined appearances and having predetermined object manipulation attributes, upon initiation of the gaming session the gaming system randomly determines an appearance (e.g., from a plurality of appearances) and a plurality of object manipulation attributes (e.g., from a plurality of object manipulation attributes) for each of a certain quantity of dealers. In some embodiments, the gaming system selects a subset of predetermined dealers from a larger set of dealers upon initiation of a gaming session, and displays that subset to the player. It should thus be appreciated that these embodiments may provide the player with the appearance of a new set of dealers each time the player initiates a gaming session.

FIGS. 4A, 4B, 4C, 4D, 4E, 4F, 4G, and 4H illustrate screen shots of an example embodiment of a gaming system, gaming device, and method of operating the gaming system and gaming device. In this example, the dealer-based game is a blackjack game. Accordingly, the object manipulation attributes are card dealing attributes in this example. In this embodiment, the gaming system includes a plurality of different predetermined dealers, each of which has an appearance and is associated with one or more of the card dealing attributes. Upon initiation of a gaming session, the gaming system enables a player to select one of the dealers for use in one or more plays of a dealer-based game or create a custom dealer for use in one or more plays of the dealer-based game.

Figure 4A:
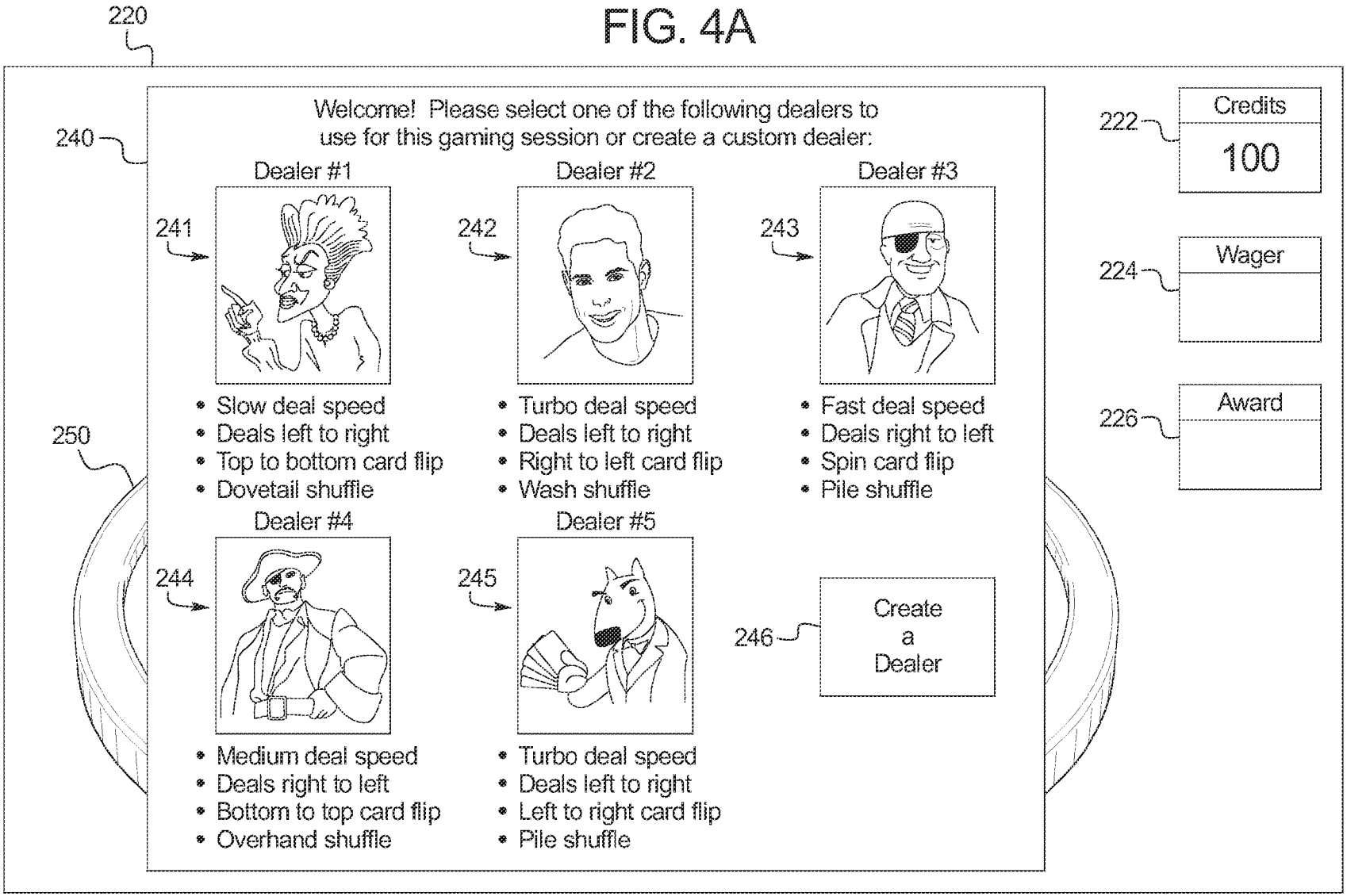
FIGS. 4A, 4B, 4C, 4D, 4E, 4F, 4G, and 4H are front views of a display device of an example gaming system or gaming device of another embodiment the present disclosure, and illustrate a player's creation of a custom dealer and a play of a dealer-based game in accordance with the card dealing attributes of the created custom dealer.

As illustrated in FIG. 4A, a player has initiated a gaming session by depositing 100 credits into the gaming system. The player's credits are displayed by a display device 220 in a credit meter 222. Display device 220 also includes a wager meter 224, which displays any wager placed by the player for a play of the blackjack game, and an award meter 226, which displays any award or awards won by the player for a play of the blackjack game. Upon initiation of the gaming session, display device 220 displays an indication box 240, which includes a message welcoming the player and directing the player to either: (a) select one of five different dealers Dealer 1 241, Dealer 2 242, Dealer 3 243, Dealer 4 244, or Dealer 5 245 (referred to herein as Dealers 1, 2, 3, 4, and 5 for clarity and brevity); or (b) indicate that the player wishes to create a custom dealer by actuating CREATE A DEALER button 246.

More specifically, indication box 240 includes an illustration, picture, or animation of each dealer and a plurality of card dealing attributes associated with each dealer. Dealer 1 has the appearance of an elderly woman with long hair, and includes the following card dealing attributes: slow deal speed, left to right deal direction, top to bottom card flip card face reveal, and dovetail card shuffle. Dealer 2 has the appearance of a young man with short hair, and includes the following card dealing attributes: turbo deal speed, left to right deal direction, right to left card flip card face reveal, and wash card shuffle. Dealer 3 has the appearance of an elderly man with an eye patch, and includes the following card dealing attributes: fast deal speed, right to left deal direction, spin card flip card face reveal, and pile card shuffle. Dealer 4 has the appearance of a pirate, and includes the following card dealing attributes: medium deal speed, right to left deal direction, bottom to top card flip card face reveal, and overhand card shuffle. Dealer 5 has the appearance of a dog, and includes the following card dealing attributes: turbo deal speed; left to right deal direction, left to right card flip card face reveal, and pile card shuffle.

Figure 4B:
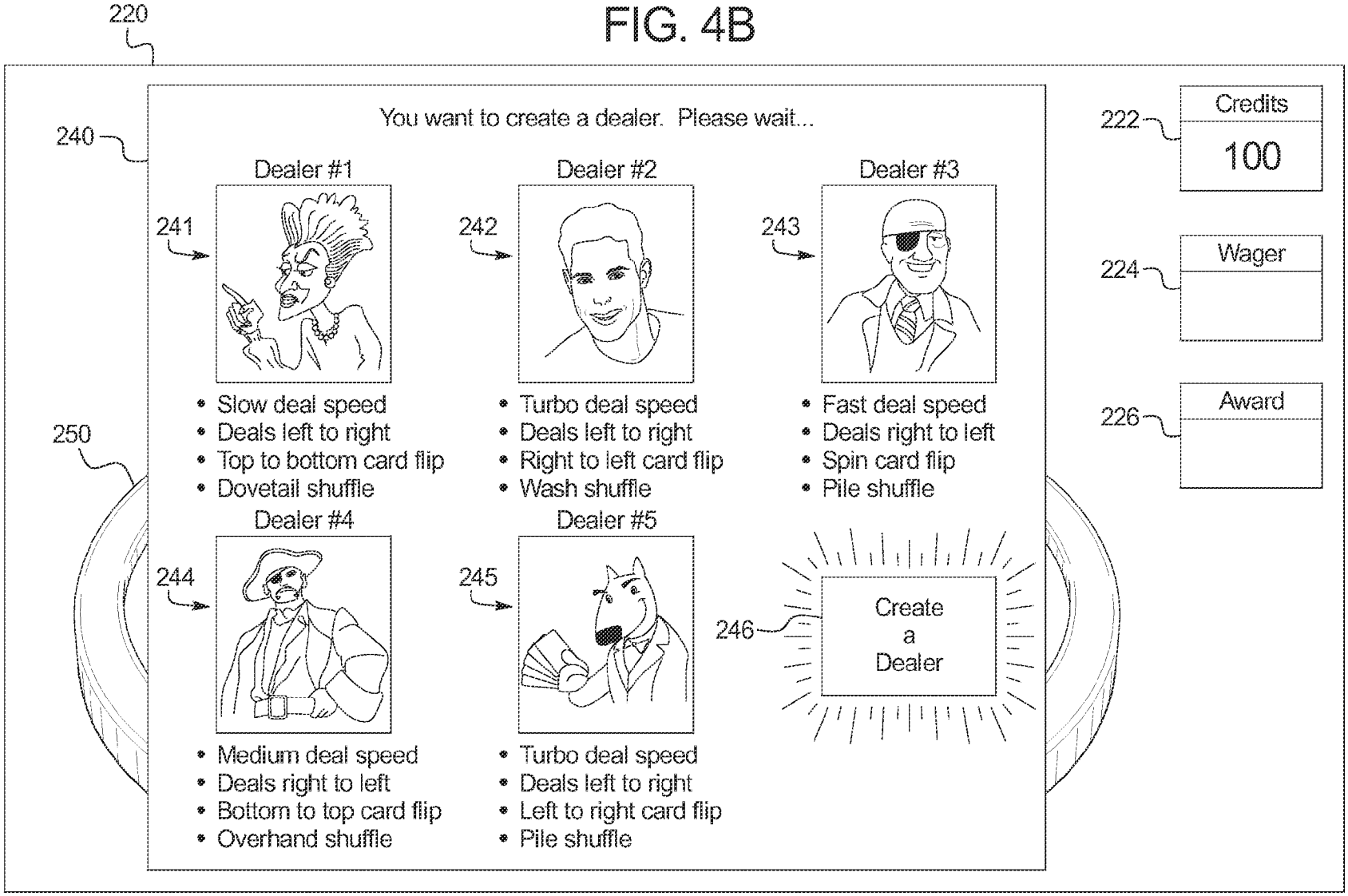

As illustrated in FIG. 4B, the player actuates CREATE A DEALER button 246 to create a custom dealer for use in the blackjack game. Indication box 240 displays a notification asking the player to wait while a card dealing attribute and appearance selection screen is displayed.

Figure 4C:
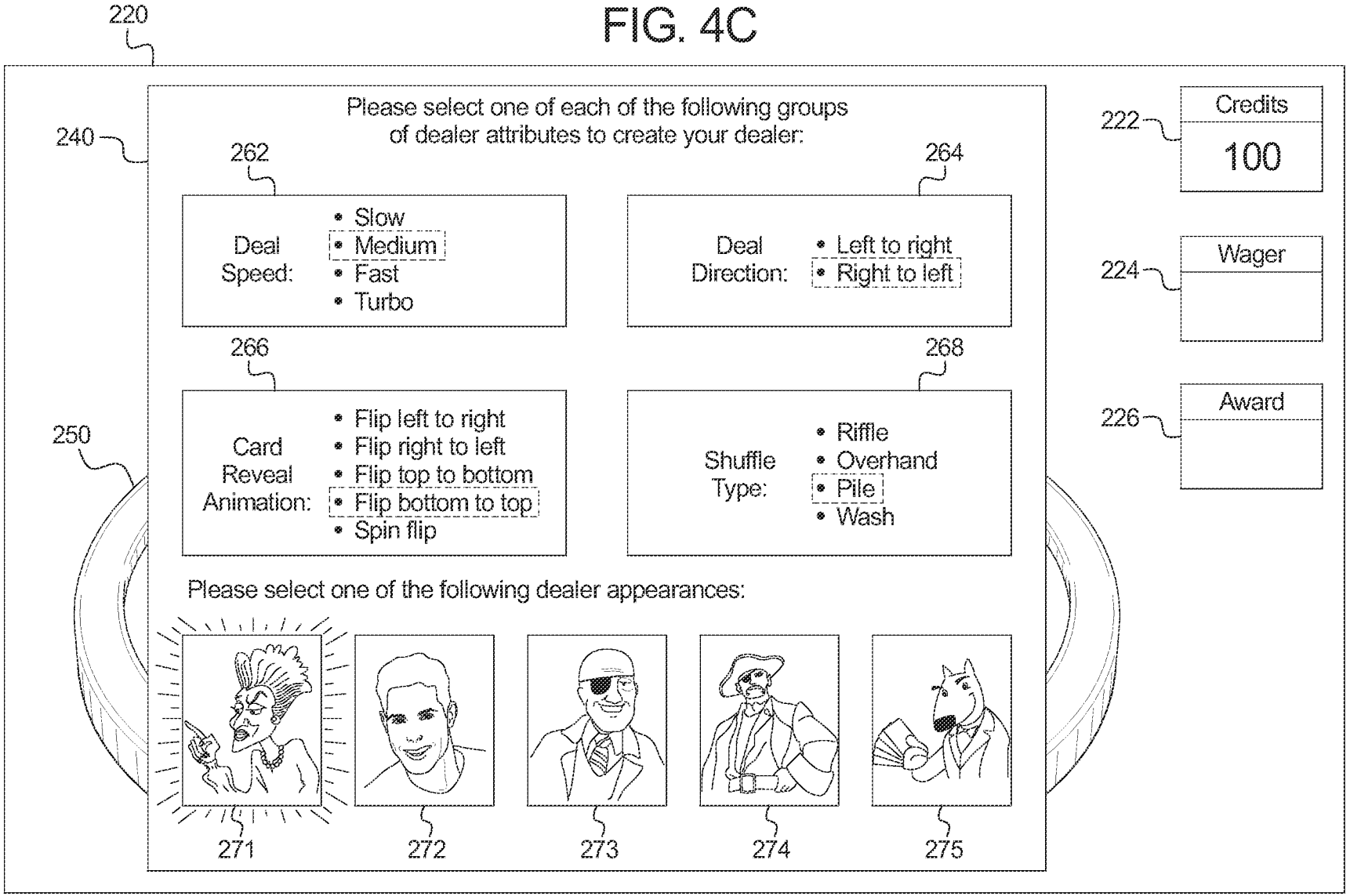

As illustrated in FIG. 4C, indication box 240 displays the card dealing attribute and appearance selection screen. Specifically, indication box 240 displays a deal speed attribute group 262, a deal direction attribute 264, a card reveal animation attribute group 266, and a shuffle animation attribute group 268. Deal speed attribute group 262 includes four deal speed attributes: a slow deal speed attribute, a medium deal speed attribute, a fast deal speed attribute, and a turbo deal speed attribute. Deal direction attribute group 264 includes two deal direction attributes: a left to right deal direction attribute and a right to left deal direction attribute. Card reveal animation attribute group 266 includes five card reveal animation attributes: a left to right card flip card reveal animation attribute, a right to left card flip card reveal animation attribute, a top to bottom card flip card reveal animation attribute, a bottom to top card flip card reveal animation attribute, and a spin card flip card reveal animation attribute. Shuffle animation attribute 268 includes four shuffle animation attributes: a riffle shuffle animation attribute, an overhand shuffle animation attribute, a pile shuffle animation attribute, and a wash shuffle animation attribute. Indication box 240 also displays five dealer appearances: a first dealer appearance 271 (an elderly woman with long hair), a second dealer appearance 272 (a young man with short hair), a third dealer appearance 273 (an elderly man with an eye patch), a fourth dealer appearance 274 (a pirate), and a fifth dealer appearance 275 (a dog).

Indication box 240 includes an instruction to the player to select one of the card dealing attributes of each group of card dealing attributes and one of the dealer appearances. As shown in FIG. 4C, the player selected the medium deal speed attribute from deal speed attribute group 262, the right to left deal direction attribute from deal direction attribute group 264, the bottom to top card flip card reveal animation attribute from card reveal animation attribute group 266, the pile shuffle animation attribute from shuffle animation attribute group 268, and first dealer appearance 271.

Figure 4D:
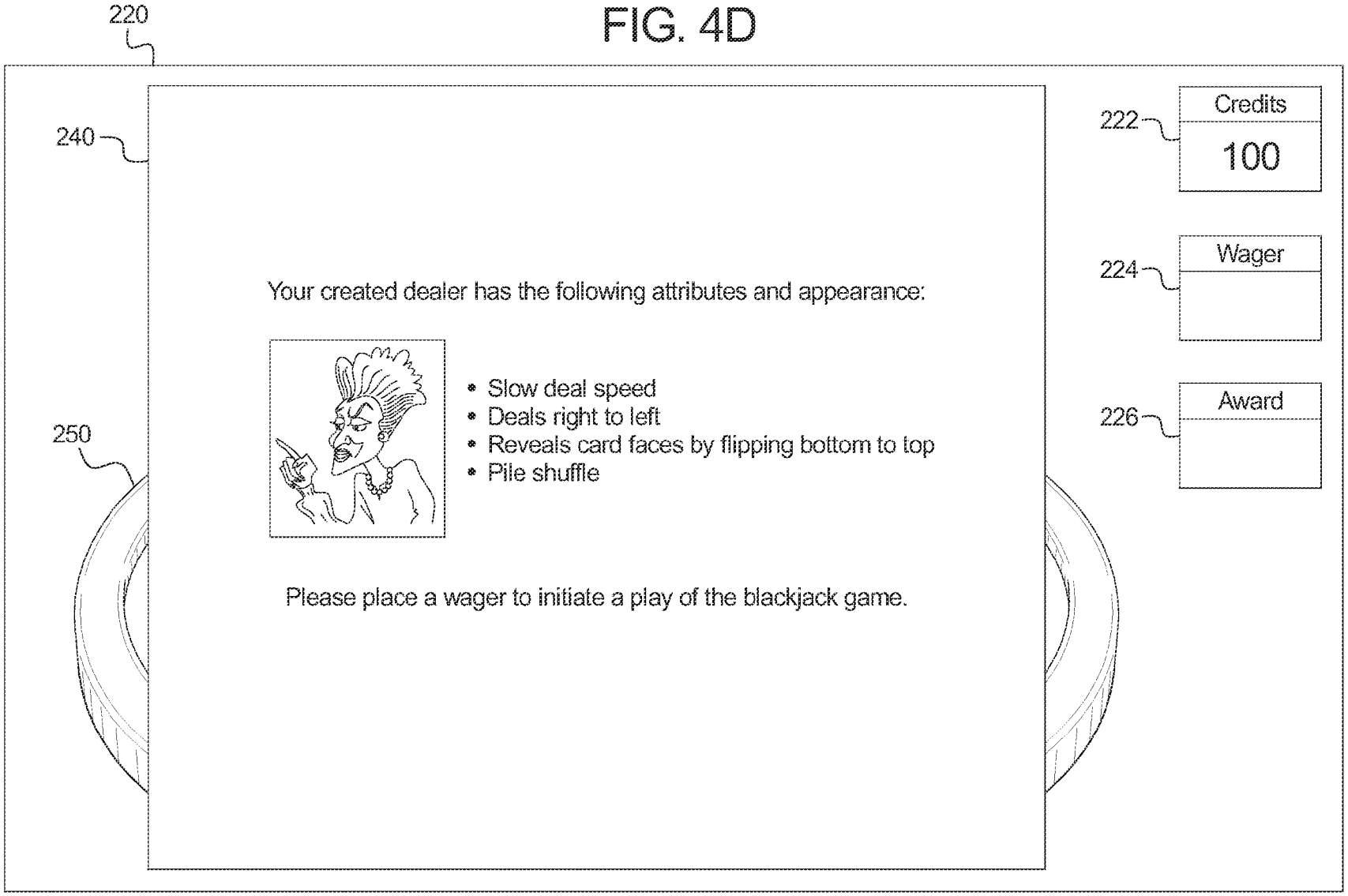

As illustrated in FIG. 4D, indication box 240 displays the selected dealer appearance (i.e., first dealer appearance 271 in this example) and the selected card dealing attributes (i.e., the medium deal speed attribute, the right to left deal direction attribute, the bottom to top card flip card reveal animation attribute, and the pile shuffle animation attribute in this example), and displays a notification asking the player to place a wager to initiate a play of the blackjack game.

Figure 4E:
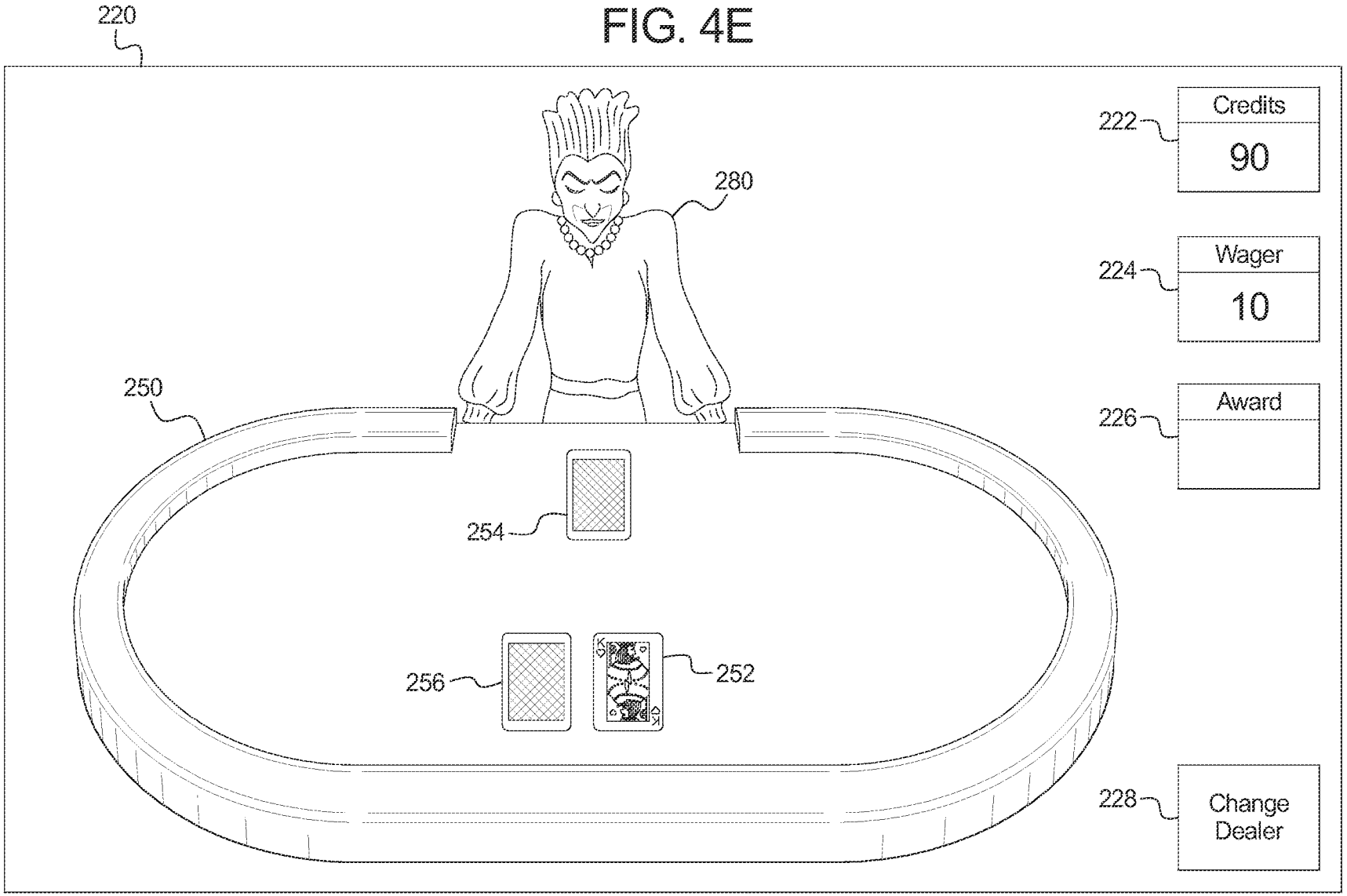
Figure 4F:
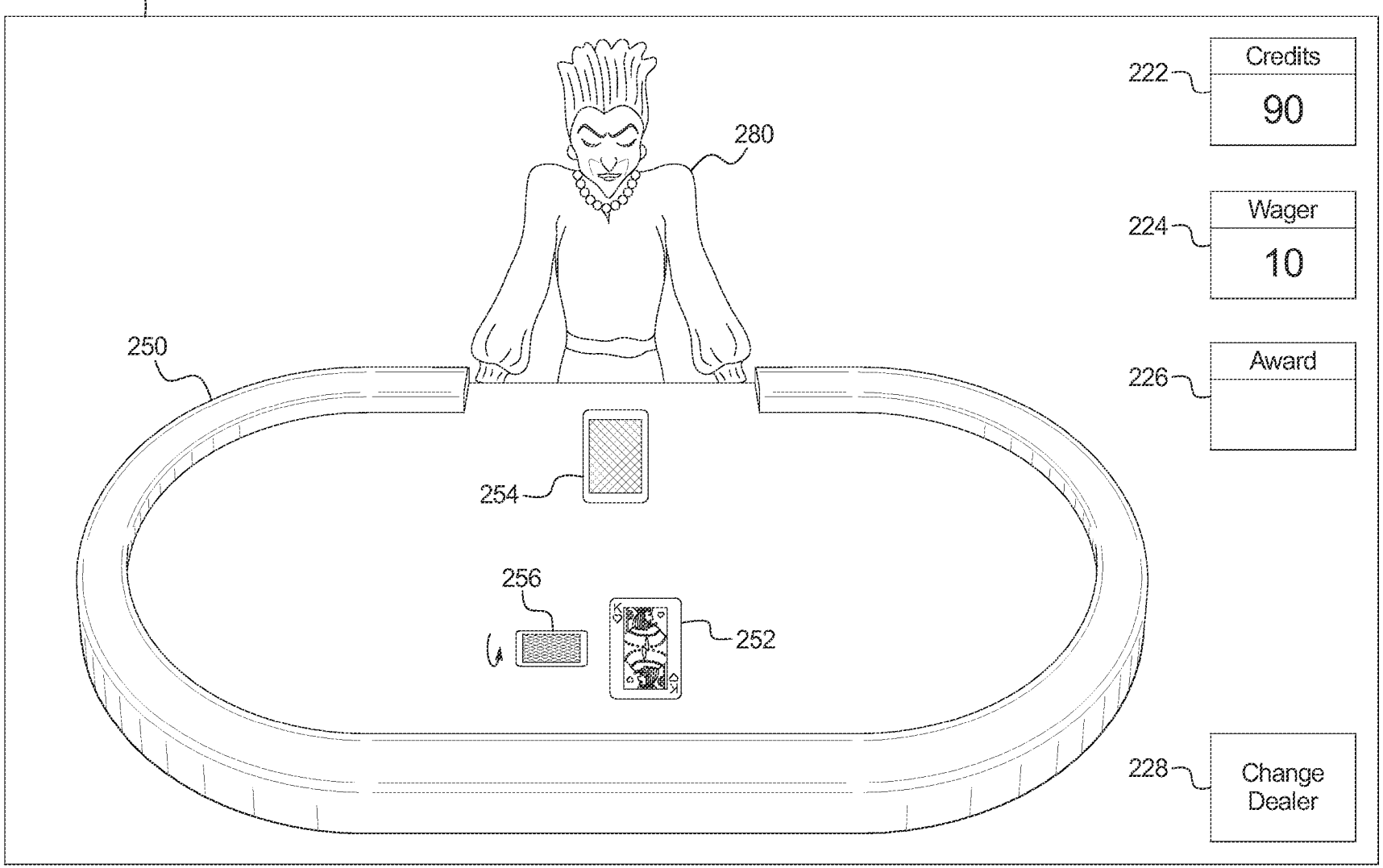
Figure 4G:
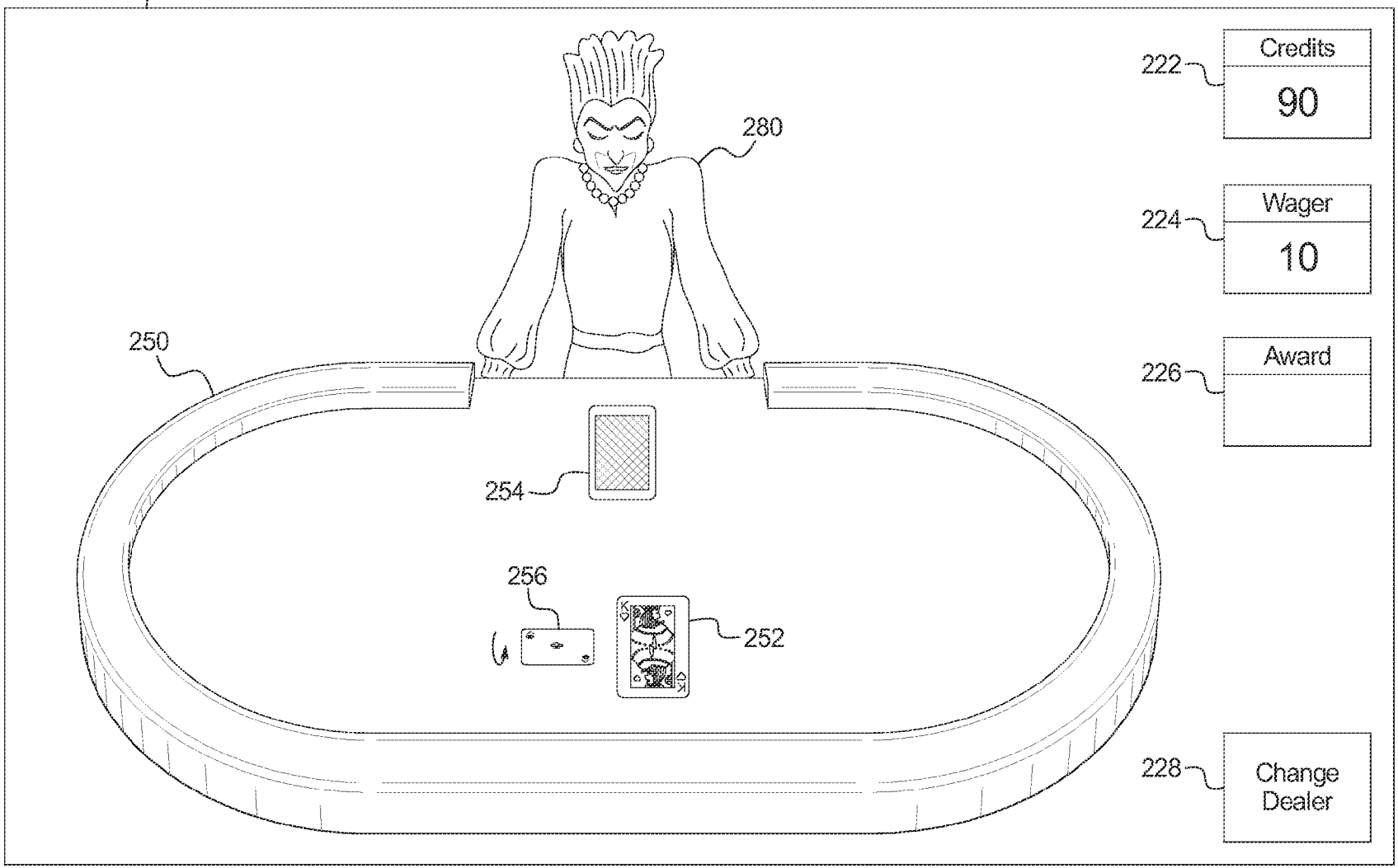
Figure 4H:
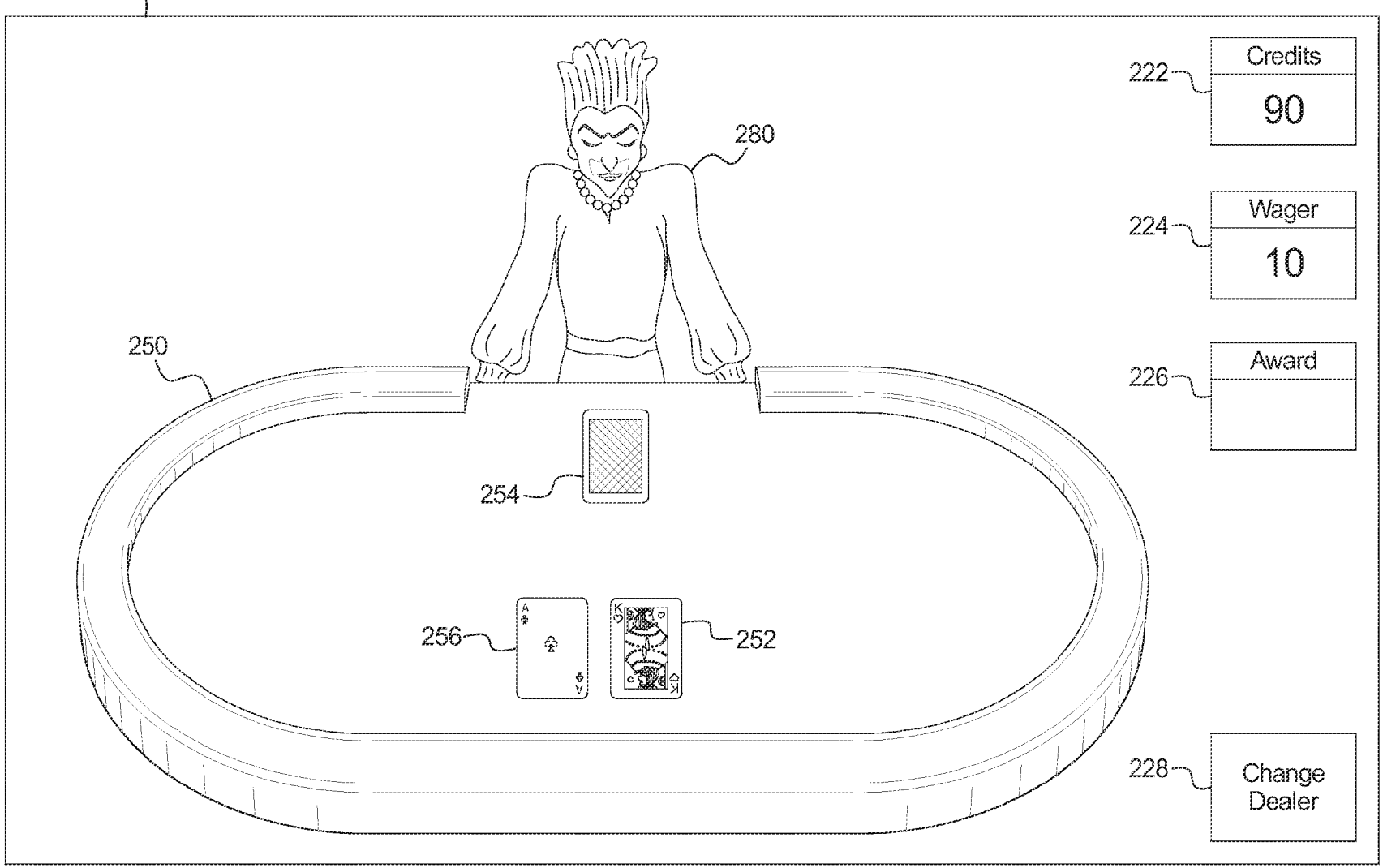

As illustrated in FIG. 4E, the gaming system received a wager of ten credits for a play of the blackjack game. Wager meter 224 displays the ten credit wager, and credit meter 222 displays the player's credit balance of ninety credits, which reflects the player's initial credit balance of 100 credits minus the player's wager of ten credits. Upon initiation of the play, display device 220 displays custom dealer 280 (which was created by the player) on one side of a game table 250. The gaming system displays custom dealer 280 shuffling and dealing cards of the blackjack game in accordance with the following selected card dealing attributes of custom dealer 280: medium deal speed, right to left deal direction, bottom to top card flip card face reveal, and pile card shuffle.

Specifically, as illustrated in FIGS. 4E, 4F, 4G, and 4H, display device 220 displays custom dealer 280 dealing and revealing a first player card 252 to the player, then dealing a face down first dealer card 254 to custom dealer 280, and then dealing and beginning to reveal a second player card 256 to the player. First player card 252, which was dealt first, is positioned to the right of second player card 256, which was subsequently dealt. Thus, custom dealer 280 deals from right to left in accordance with the corresponding selected deal direction attribute of custom dealer 280. Additionally, as illustrated in the progression of FIGS. 4E to 4H, custom dealer 280 reveals the faces of the cards (which are initially dealt face down) by flipping the cards from bottom to top, as illustrated in association with second player card 256 and in accordance with the corresponding selected card reveal animation attribute of custom dealer 280.

In this embodiment, display device 220 displays a CHANGE DEALER button 228. The gaming system enables the player to actuate CHANGE DEALER button 228 during play of the blackjack game. When the player actuates CHANGE DEALER button 228, the gaming system enables the player to select a different dealer or create a different dealer for use in one or more plays of the blackjack game.

Figure 5B:
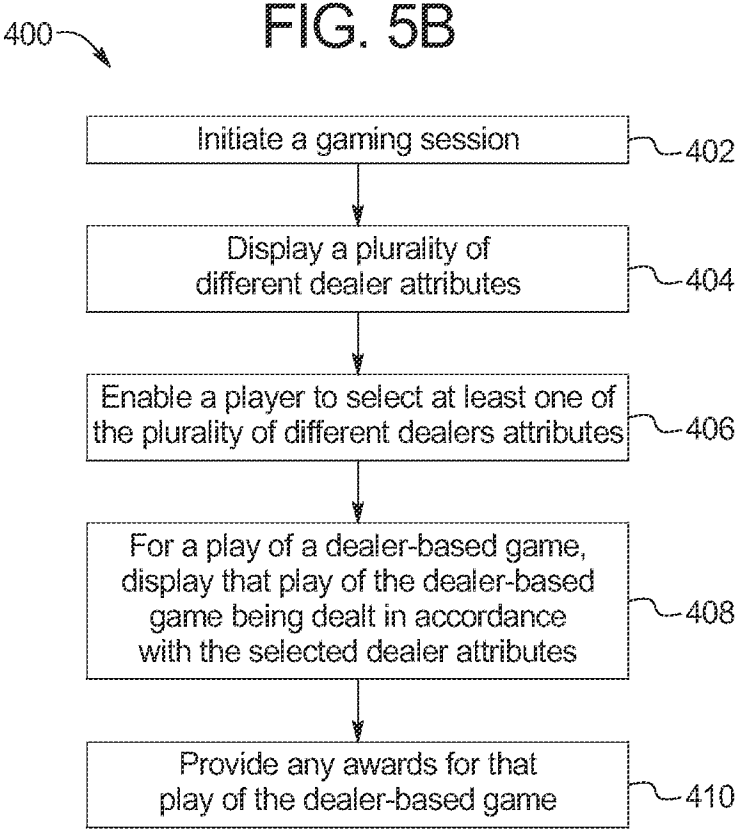
FIG. 5B is a flow chart of an example process for operating a gaming system or gaming device of another embodiment of the present disclosure providing player selectable object manipulation attributes.
Figure 5A:
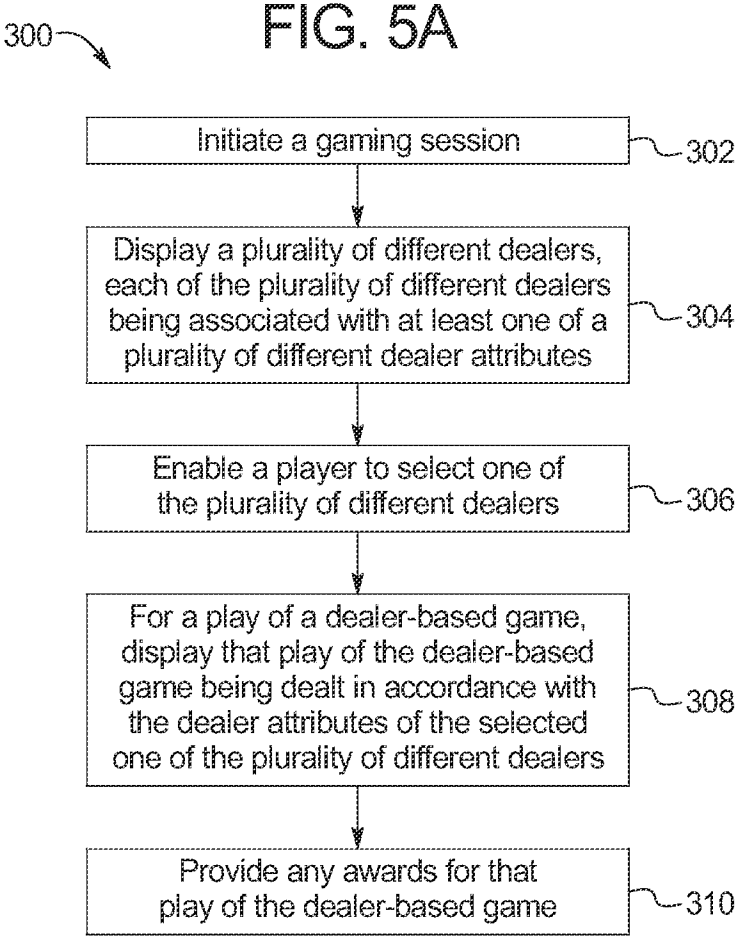
FIG. 5A is a flow chart of an example process for operating a gaming system or gaming device of one embodiment of the present disclosure providing player selectable dealers having different object manipulation attributes.

FIGS. 5A and 5B illustrate flowcharts of two example embodiments of a process or method 300 for operating a gaming system or a gaming device and a process or method 400 for operating a gaming system or a gaming device. In certain embodiments, one or more of these processes 300 and 400 are embodied in one or more software programs stored in one or more memories and executed by one or more processors or controllers. Although these processes 300 and 400 are described with reference to the flowcharts shown in FIGS. 5A and 5B, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, as shown in FIG. 5A the gaming system initiates a gaming session for a player, as indicated by block 302. The gaming system displays a plurality of different dealers, each of which is associated with at least one of a plurality of different object manipulation attributes, as indicated by block 304. The gaming system enables the player to select one of the plurality of different dealers, as indicate by block 306. For a play of a dealer-based game, the gaming system displays that play of the dealer-based game being operated in accordance with the object manipulation attributes of the selected one of the plurality of different dealers, as indicated by block 308. The gaming system provides any awards for that play of the dealer-based game, as indicated by block 310.

In operation of another embodiment, as shown in FIG. 5B, the gaming system initiates a gaming session for a player, as indicated by block 402. The gaming system displays a plurality of different object manipulation attributes, as indicated by block 404. The gaming system enables the player to select at least one of the plurality of different object manipulation attributes, as indicated by block 406. For a play of a dealer-based game, the gaming system displays that play of the dealer-based game being operated in accordance with the selected object manipulation attributes, as indicated by block 408. The gaming system provides any awards for that play of the dealer-based game, as indicated by block 410.

Figure 6:
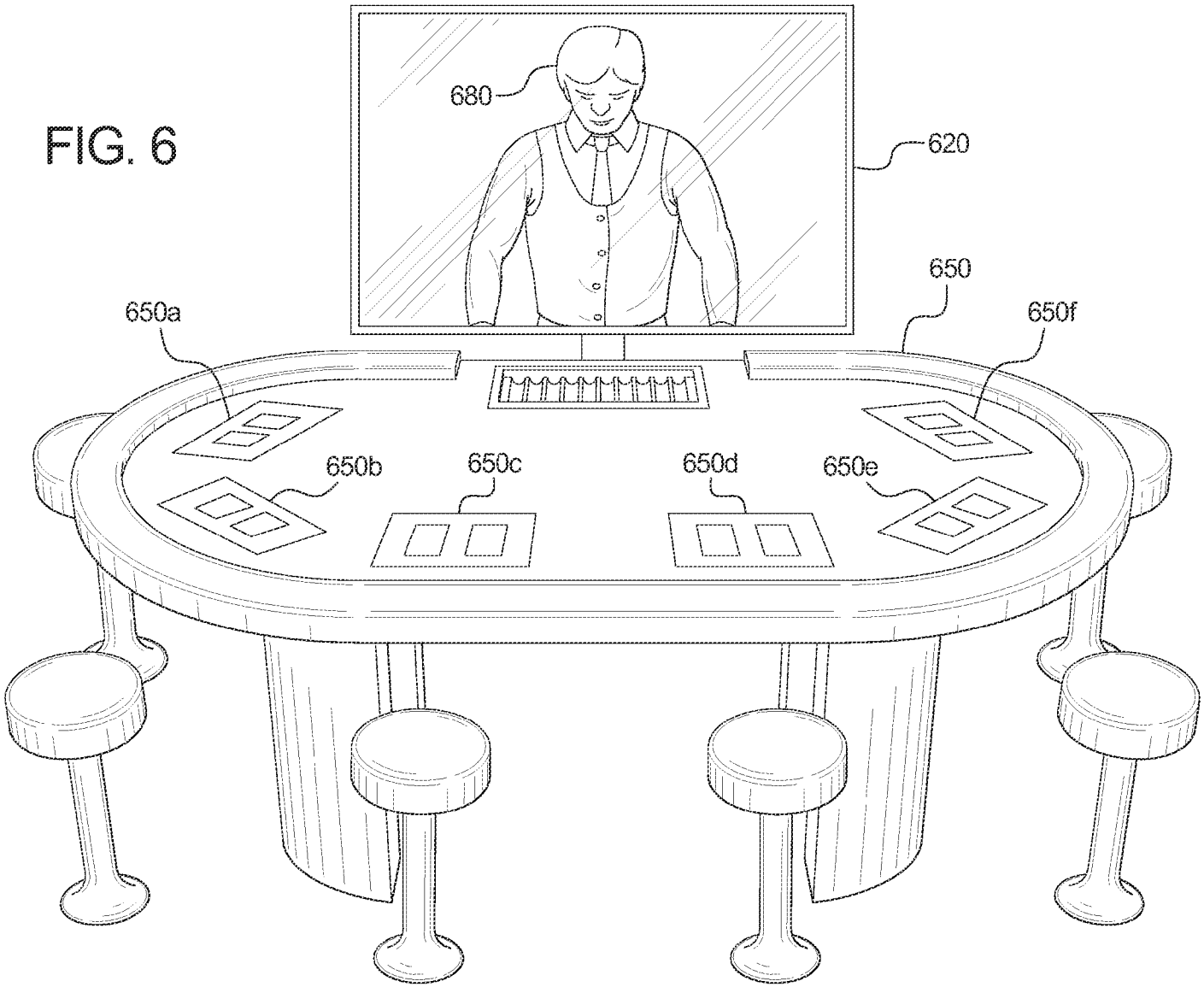
FIG. 6 is a perspective view of an example community gaming system of one embodiment of the present disclosure that is configured to operate a community dealer-based game in accordance with the object manipulation attributes of a selected or custom created dealer.

In certain embodiments, the gaming system is a multi-player or community gaming system that enables a plurality of players to play a dealer-based game at once. In some embodiments, the players share a common dealer. An example of these embodiments is illustrated in FIG. 6, which shows a gaming system configured to operate a community dealer-based game, which is a blackjack game in this example. The gaming system including a community dealer display 620 and a gaming table 650. Gaming table 650 includes a plurality of player stations 650*a*, 650*b*, 650*c*, 650*d*, 650*e*, and 650*f*, each of which may be employed by a player to play the blackjack game. During play of the blackjack game, selected or custom created dealer 680 is displayed operating the blackjack game according to the card dealing characteristics associated with dealer 680.

In various embodiments, the gaming system determines which of the players to enable to select the dealer or create a custom dealer: (a) randomly, (b) based on any wagers placed by the players, (c) based on information stored in player tracking accounts associated with the players, (d) based on prior outcomes of the dealer-based game, (e) based on the occurrence of one or more of the triggering conditions described above, or (f) in any other suitable manner.

In certain embodiments, dealer selection is turn-based, meaning that the gaming system enables each player, at one time or another, to select or change the dealer. For example, the gaming system may provide each player with a different consecutive two minute time interval during which that player may select or change the dealer (e.g., the gaming system enables Player 1 to change the dealer during the first two minutes, Player 2 during the following two minutes, and so on). In other embodiments, the gaming system enables the player with the worst losing streak at a given point in time to change the dealer. For example, if three players are playing the dealer-based game and two of those players are on three-game winning streaks while the other is on a six-game losing streak, the gaming system enables the player on the losing streak to change the dealer. In this example, the player may do so until another one of the players has a worse losing streak. In one embodiment, when one player is on a losing streak if another player is on a winning streak, the gaming system does not enable the player on the losing streak to change the dealer until the other player's winning streak is stopped.

In other embodiments, the players work together to create a dealer or select a dealer. In one example, the gaming system enables each player or a plurality of players to select at least one object manipulation attribute and/or at least one element or characteristic of the dealer's appearance. In another example, the gaming system enables each player to place a vote on object manipulation attributes and/or elements or characteristics of the dealer's appearance, and the majority vote is implemented. In certain embodiments, the gaming system enables players with losing streaks to pick more object manipulation attributes or appearance characteristics or elements than players on winning streaks. It should be appreciated that the gaming system may enable players with relatively worse losing streaks to select more object manipulation attributes or appearance characteristics or elements.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device storing a plurality of instructions which, when executed by the at least one processor, cause the at least one processor to operate with the at least one display device and the at least one input device to:

(a) enable a player to select one of a plurality of different virtual dealers, each of the plurality of different virtual dealers being associated with one or more of a plurality of different card dealing attributes, the card dealing attributes associated with at least two of the virtual dealers being different, wherein the plurality of different card dealing attributes include one or more of: a plurality of deal direction attributes, a plurality of card face reveal animation attributes, and a plurality of card shuffle animation attributes; and (b) for each of one or more plays of a dealer-based card game, display said play of the dealer-based card game being dealt in accordance with the card dealing attributes of the selected one of the plurality of different virtual dealers.

2. The gaming system of claim 1, wherein each of the plurality of different virtual dealers is associated with:

(a) one of the plurality of deal speed attributes, (b) one of the plurality of deal direction attributes, (c) one of the plurality of card face reveal animation attributes, and (d) one of the plurality of card shuffle animation attributes.

3. The gaming system of claim 1, wherein the plurality of instructions, when executed by the at least one processor, cause the at least one processor to operate with the at least one display device to, for each of the one or more plays of the dealer-based card game, display said play of the dealer-based card game being dealt in accordance with the card dealing attributes of the selected one of the plurality of different virtual dealers by displaying the selected one of the plurality of different virtual dealers dealing said play of the dealer-based card game.

4. The gaming system of claim 1, wherein the plurality of instructions, when executed by the at least one processor, cause the at least one processor to operate with the at least one display device and the at least one input device to, after selection of one of the plurality of different virtual dealers:

(a) enable the player to select a second one of the plurality of different virtual dealers, and (b) thereafter, for another play of the dealer-based card game, display said play of the dealer-based card game being dealt in accordance with the card dealing attributes of the selected second one of the plurality of different virtual dealers.

5. The gaming system of claim 1, wherein the plurality of instructions, when executed by the at least one processor, cause the at least one processor to operate with the at least one display device and the at least one input device to enable the player to select one of the plurality of different virtual dealers upon an occurrence of a triggering event.

6. The gaming system of claim 5, wherein the triggering event occurs when the player has lost a predetermined quantity of consecutive plays of the dealer-based card game.

7. A gaming system comprising:

at least one processor;

at least one display device;

at least one input device; and at least one memory device storing a plurality of instructions which, when executed by the at least one processor, cause the at least one processor to operate with the at least one display device and the at least one input device to:

(a) enable a player to select one of a plurality of different card face reveal animation attributes, each card face reveal animation attribute being associated with a manner in which a face of a dealt card is displayed to the player; and (b) for each of one or more plays of a dealer-based card game, display said play of the dealer-based card game being dealt in accordance with the selected card face reveal animation attribute.

8. The gaming system of claim 7, wherein the plurality of instructions, when executed by the at least one processor, cause the at least one processor to operate with the at least one display device and the at least one input device to enable the player to additionally select at least one of: one of a plurality of deal speed attributes, one of a plurality of deal direction attributes, and one of a plurality of card shuffle animation attributes.

9. The gaming system of claim 7, wherein the plurality of instructions, when executed by the at least one processor, cause the at least one processor to operate with the at least one display device to, for each of the one or more plays of the dealer-based card game, display said play of the dealer-based card game being dealt in accordance with the selected card face reveal animation attribute by displaying a virtual dealer dealing said play of the dealer-based card game.

10. The gaming system of claim 7, wherein the plurality of instructions, when executed by the at least one processor, cause the at least one processor to operate with the at least one display device and the at least one input device to, after selection of the card face reveal animation attribute:

(a) enable the player to select a second one of the card face reveal animation attributes, and (b) thereafter, for a play of the dealer-based card game, display said play of the dealer-based card game being dealt in accordance with the second selected card face reveal animation attribute.

11. The gaming system of claim 7, wherein the plurality of instructions, when executed by the at least one processor, cause the at least one processor to operate with the at least one display device and the at least one input device enable the player to select one of the plurality of different card face reveal animation attributes upon an occurrence of a triggering event.

12. The gaming system of claim 11, wherein the triggering event occurs when the player has lost a predetermined quantity of consecutive plays of the dealer-based card game.

13. The gaming system of claim 7, wherein the plurality of instructions, when executed by the at least one processor, cause the at least one processor to store the selected card face reveal animation attribute in a player tracking account associated with the player.

14. A gaming system comprising:

at least one processor;

at least one display device;

at least one input device; and at least one memory device storing a plurality of instructions which, when executed by the at least one processor, cause the at least one processor to operate with the at least one display device and the at least one input device to:

(a) for a single play of a dealer-based card game, enable a player to select one of a plurality of different sets of card dealing attributes, each of the plurality of different sets of card dealing attributes usable in said single play of the dealer-based card game and including one or more of a plurality of different card dealing attributes, wherein the plurality of different card dealing attributes include one or more of: a plurality of deal direction attributes, a plurality of card face reveal animation attributes, and a plurality of card shuffle animation attributes; and (b) for said single play of the a-dealer-based card game, display said single play of the dealer-based card game being dealt in accordance with the card dealing attributes of the selected one of the plurality of different sets of card dealing attributes.

15. The gaming system of claim 14, wherein each of the plurality of different sets of card dealing attributes is associated with:

(a) one of the plurality of deal speed attributes, (b) one of the plurality of deal direction attributes, (c) one of the plurality of card face reveal animation attributes, and (d) one of the plurality of card shuffle animation attributes.

16. The gaming system of claim 14, wherein the plurality of instructions, when executed by the at least one processor, cause the at least one processor to operate with the at least one display device to, for said single play of the dealer-based card game, display said single play of the dealer-based card game being dealt in accordance with the card dealing attributes of the selected one of the plurality of different sets of card dealing attributes by displaying a virtual dealer dealing said single play of the dealer-based card game.

17. The gaming system of claim 14, wherein the plurality of instructions, when executed by the at least one processor, cause the at least one processor to operate with the at least one display device and the at least one input device to, after said single play of the dealer-based card game:

(a) for a second play of the dealer-based card game, enable the player to select a second one of the plurality of different sets of card dealing attributes, and (b) thereafter, for the second play of the dealer-based card game, display said second play of the dealer-based card game being dealt in accordance with the card dealing attributes of the selected second one of the plurality of different sets of card dealing attributes.

18. The gaming system of claim 14, wherein the plurality of instructions, when executed by the at least one processor, cause the at least one processor to operate with the at least one display device and the at least one input device to enable the player to select one of the plurality of different sets of card dealing attributes upon an occurrence of a triggering event.

19. The gaming system of claim 18, wherein the triggering event occurs when the player has lost a predetermined quantity of consecutive plays of the dealer-based card game.

* * * * *